US008086115B2

(12) United States Patent
Yamasaki et al.

(10) Patent No.: US 8,086,115 B2
(45) Date of Patent: Dec. 27, 2011

(54) CONSUMABLE MANAGEMENT SYSTEM AND IMAGE FORMING APPARATUS

(75) Inventors: Naoya Yamasaki, Ebina (JP); Kenjo Nagata, Ebina (JP)

(73) Assignee: Fuji Xerox Co., Ltd, Tokyo (JP)

( * ) Notice: Subject to any disclaimer, the term of this patent is extended or adjusted under 35 U.S.C. 154(b) by 101 days.

(21) Appl. No.: 12/728,332

(22) Filed: Mar. 22, 2010

(65) Prior Publication Data

US 2011/0013915 A1 Jan. 20, 2011

(30) Foreign Application Priority Data

Jul. 17, 2009 (JP) ..... P2009-168341

(51) Int. Cl.
*G03G 15/00* (2006.01)

(52) U.S. Cl. ..... 399/8; 399/24; 399/25

(58) Field of Classification Search ..... 399/8, 9, 399/11, 12, 24–31, 109, 110, 111
See application file for complete search history.

(56) References Cited

U.S. PATENT DOCUMENTS 7,330,673 B2 * 2/2008 Eom ..... 399/24
7,983,574 B2 * 7/2011 Kolb ..... 399/24

FOREIGN PATENT DOCUMENTS

JP 2001-228761 A 8/2001
JP 2005-173088 A 6/2005
JP 2007-57632 A 3/2007
JP 2007-199642 A 8/2007
JP 2009-69530 A 4/2009

* cited by examiner

*Primary Examiner* — Hoan Tran
(74) *Attorney, Agent, or Firm* — Sughrue Mion, PLLC

(57) ABSTRACT

An image forming apparatus includes: a predicting unit that predicts a prediction lifetime of a consumable that is detachably mounted in the image forming apparatus, based on consumption information corresponding to an operation of the image forming apparatus; a connection determining unit that determines whether or not the image forming apparatus is connected to a managing apparatus that manages a replacement time of the consumable that is detachably mounted in the image forming apparatus; a consumption information transmitting unit that transmits the consumption information to the managing apparatus located outside the image forming apparatus; a managed lifetime information receiving unit as defined herein; a replacement time determining unit that determines whether or not the replacement time of the consumable has been reached; a learning unit as defined herein; and a prediction lifetime updating unit as defined herein.

16 Claims, 24 Drawing Sheets

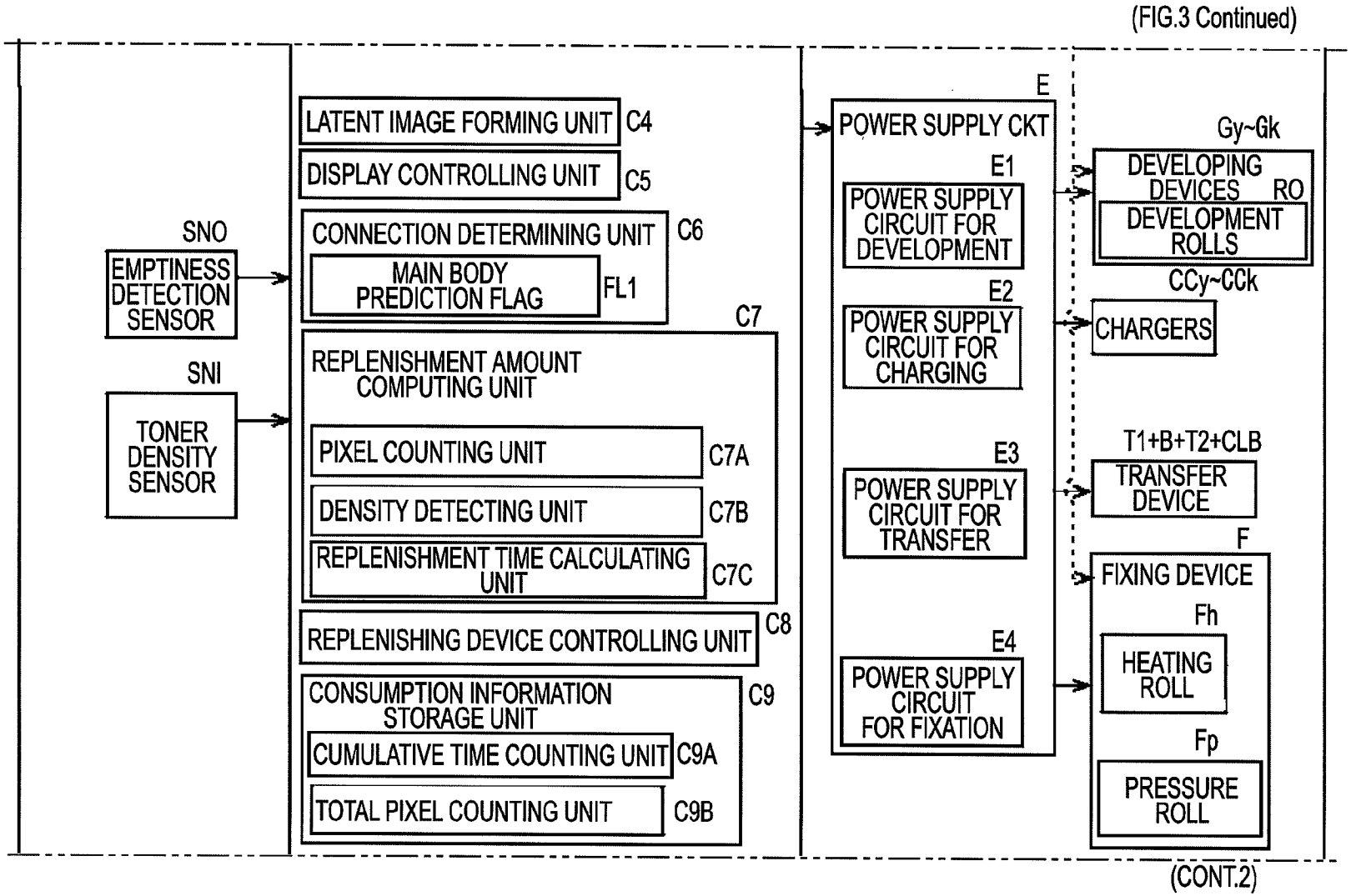
(FIG.3 Continued)
Gy~Gk
DEVELOPING DEVICES
RO
DEVELOPMENT ROLLS
CCy~CCk
CHARGERS
T1+B+T2+CLB
TRANSFER DEVICE
F
FIXING DEVICE
Fh
HEATING ROLL
Fp
PRESSURE ROLL
(CONT.2)
E
POWER SUPPLY CKT
E1
POWER SUPPLY CIRCUIT FOR DEVELOPMENT
E2
POWER SUPPLY CIRCUIT FOR CHARGING
E3
POWER SUPPLY CIRCUIT FOR TRANSFER
E4
POWER SUPPLY CIRCUIT FOR FIXATION
C4
LATENT IMAGE FORMING UNIT
C5
DISPLAY CONTROLLING UNIT
C6
CONNECTION DETERMINING UNIT
FL1
MAIN BODY PREDICTION FLAG
C7
REPLENISHMENT AMOUNT COMPUTING UNIT
C7A
PIXEL COUNTING UNIT
C7B
DENSITY DETECTING UNIT
C7C
REPLENISHMENT TIME CALCULATING UNIT
C8
REPLENISHING DEVICE CONTROLLING UNIT
C9
CONSUMPTION INFORMATION STORAGE UNIT
C9A
CUMULATIVE TIME COUNTING UNIT
C9B
TOTAL PIXEL COUNTING UNIT
SNO
EMPTINESS DETECTION SENSOR
SNI
TONER DENSITY SENSOR (FIG.3 Continued)
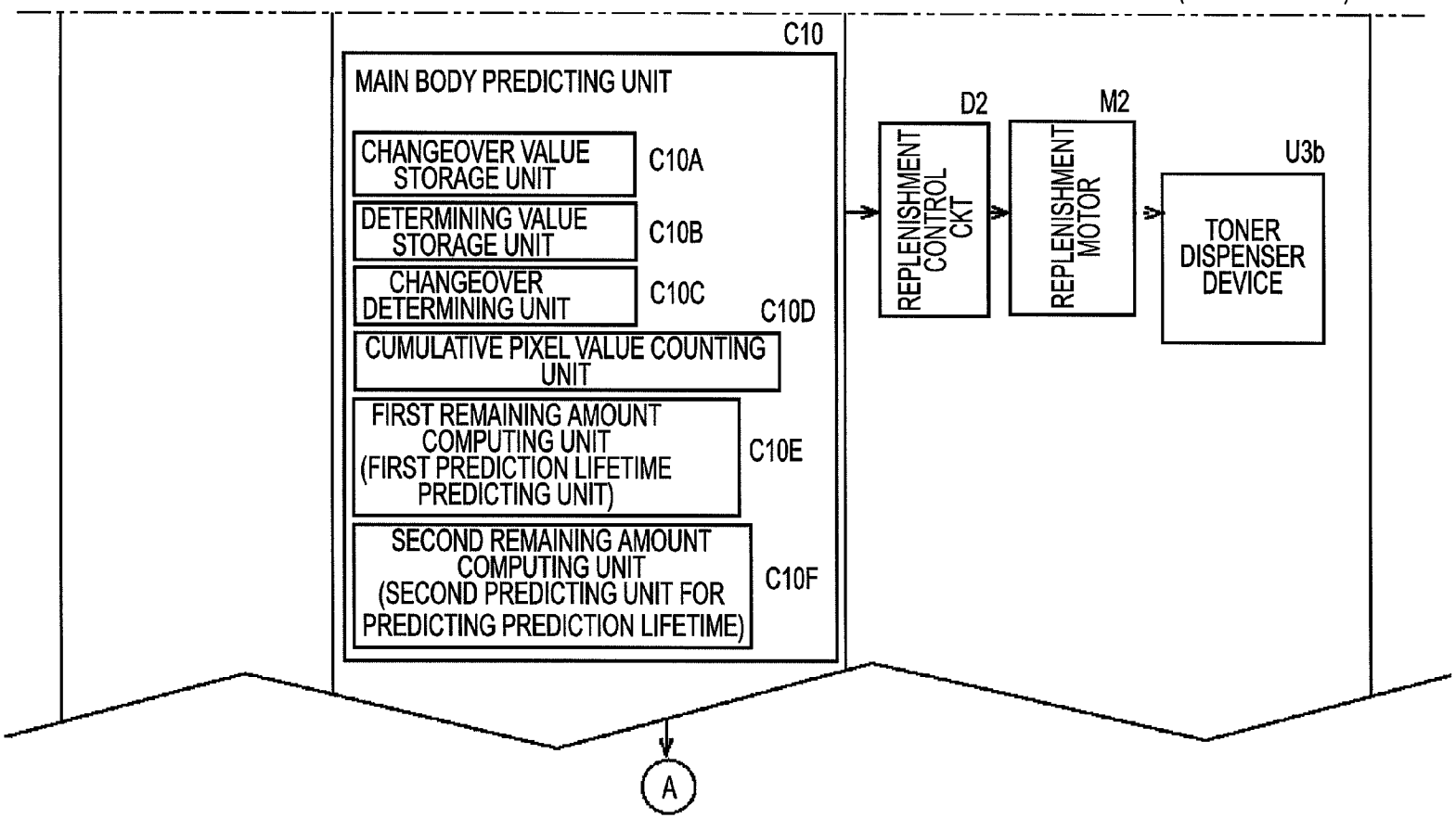

(FIG.4 Continued)
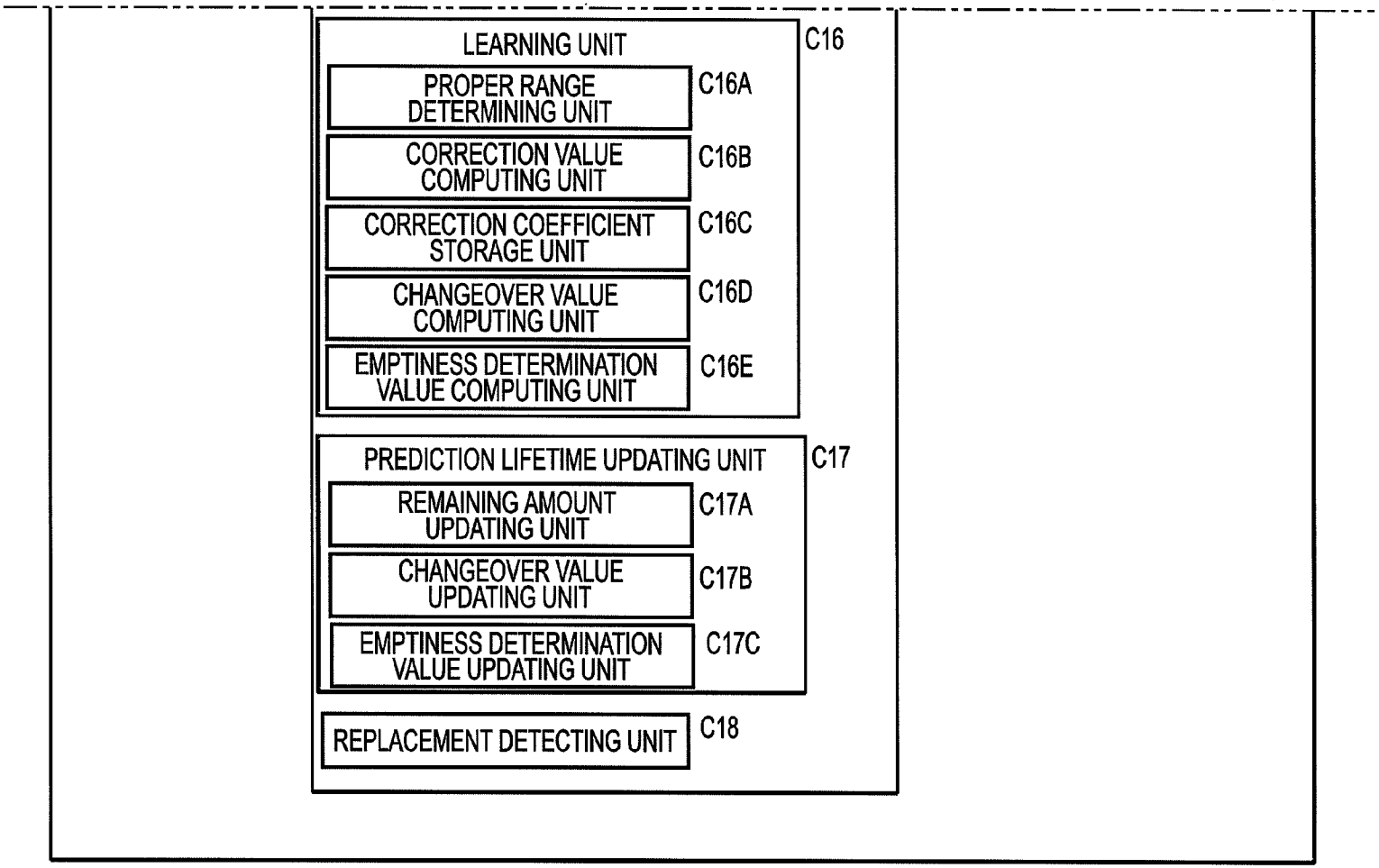

SYSTEM CONNECTION DETERMINATION PROCESSING

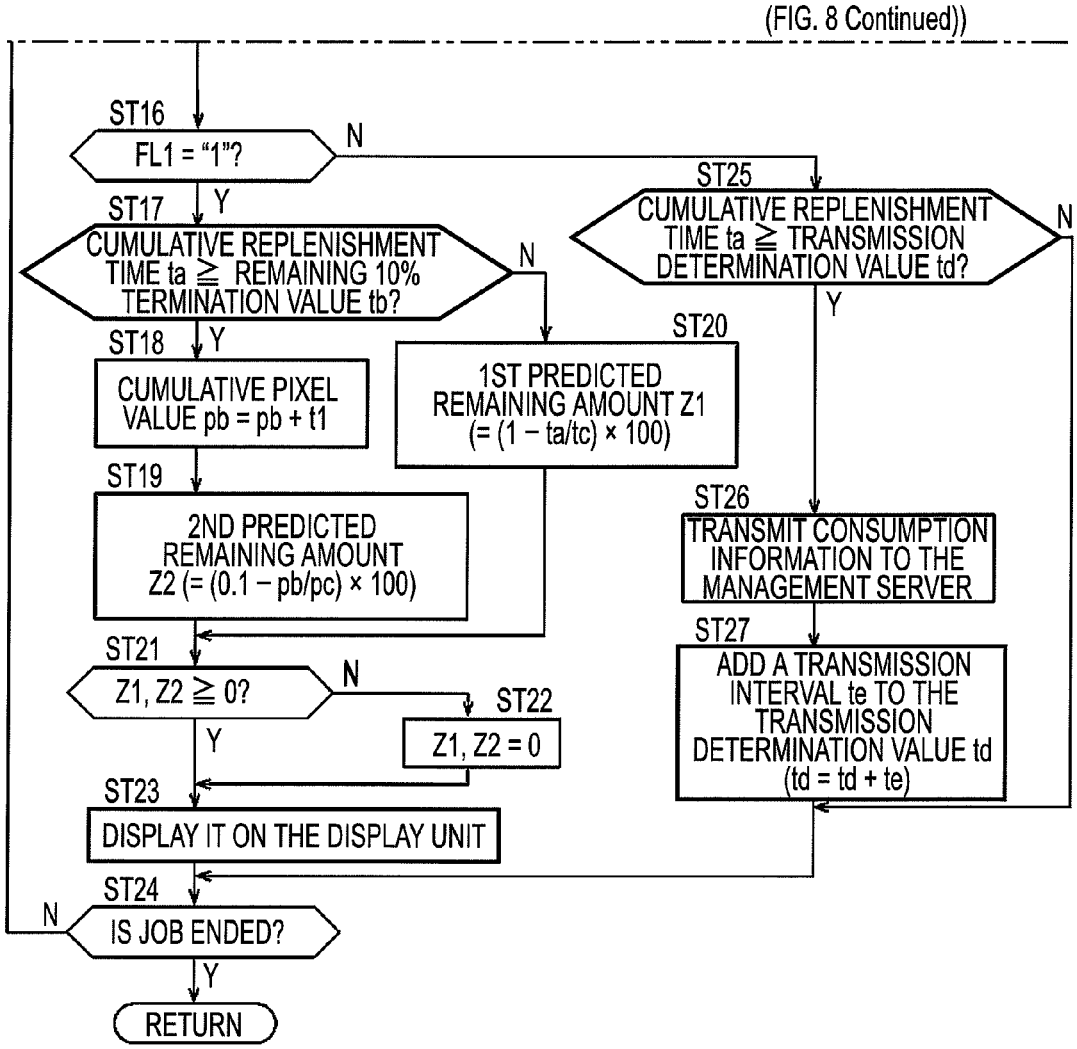
(FIG. 8 Continued))
ST16
FL1 = "1"?
N
Y
ST17
CUMULATIVE REPLENISHMENT TIME ta ≧ REMAINING 10% TERMINATION VALUE tb?
N
Y
ST18
CUMULATIVE PIXEL VALUE pb = pb + t1
ST19
2ND PREDICTED REMAINING AMOUNT Z2 (= (0.1 − pb/pc) × 100)
ST20
1ST PREDICTED REMAINING AMOUNT Z1 (= (1 − ta/tc) × 100)
ST21
Z1, Z2 ≧ 0?
N
Y
ST22
Z1, Z2 = 0
ST23
DISPLAY IT ON THE DISPLAY UNIT
ST24
IS JOB ENDED?
N
Y
RETURN
ST25
CUMULATIVE REPLENISHMENT TIME ta ≧ TRANSMISSION DETERMINATION VALUE td?
N
Y
ST26
TRANSMIT CONSUMPTION INFORMATION TO THE MANAGEMENT SERVER
ST27
ADD A TRANSMISSION INTERVAL te TO THE TRANSMISSION DETERMINATION VALUE td (td = td + te)

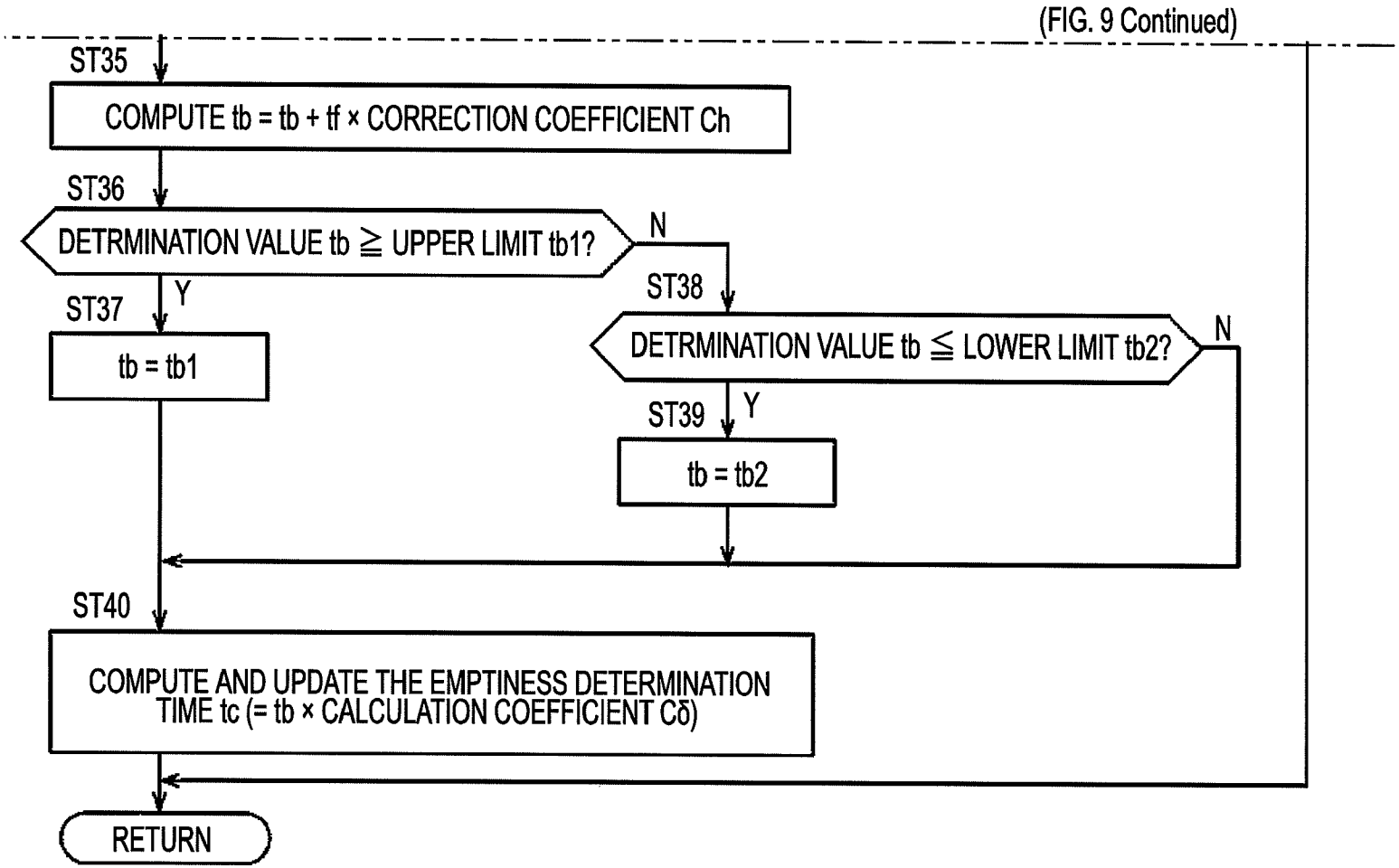
(FIG. 9 Continued)
ST35
COMPUTE tb = tb + tf × CORRECTION COEFFICIENT Ch
ST36
DETRMINATION VALUE tb ≧ UPPER LIMIT tb1?
Y
N
ST37
tb = tb1
ST38
DETRMINATION VALUE tb ≦ LOWER LIMIT tb2?
Y
N
ST39
tb = tb2
ST40
COMPUTE AND UPDATE THE EMPTINESS DETERMINATION TIME tc (= tb × CALCULATION COEFFICIENT Cδ)
RETURN (FIG.13 Continued)
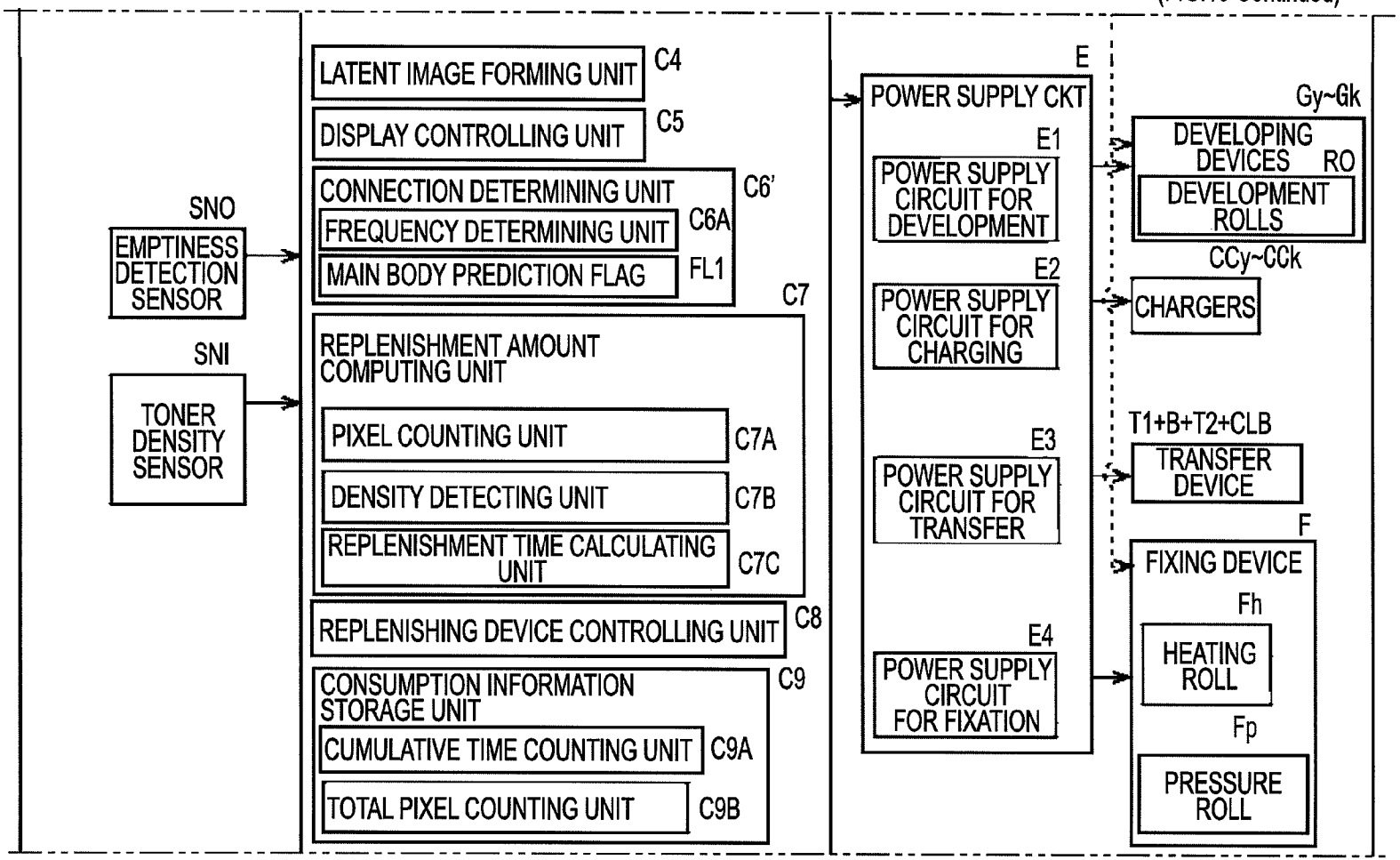
(CONT.2)

(FIG.13 Continued)
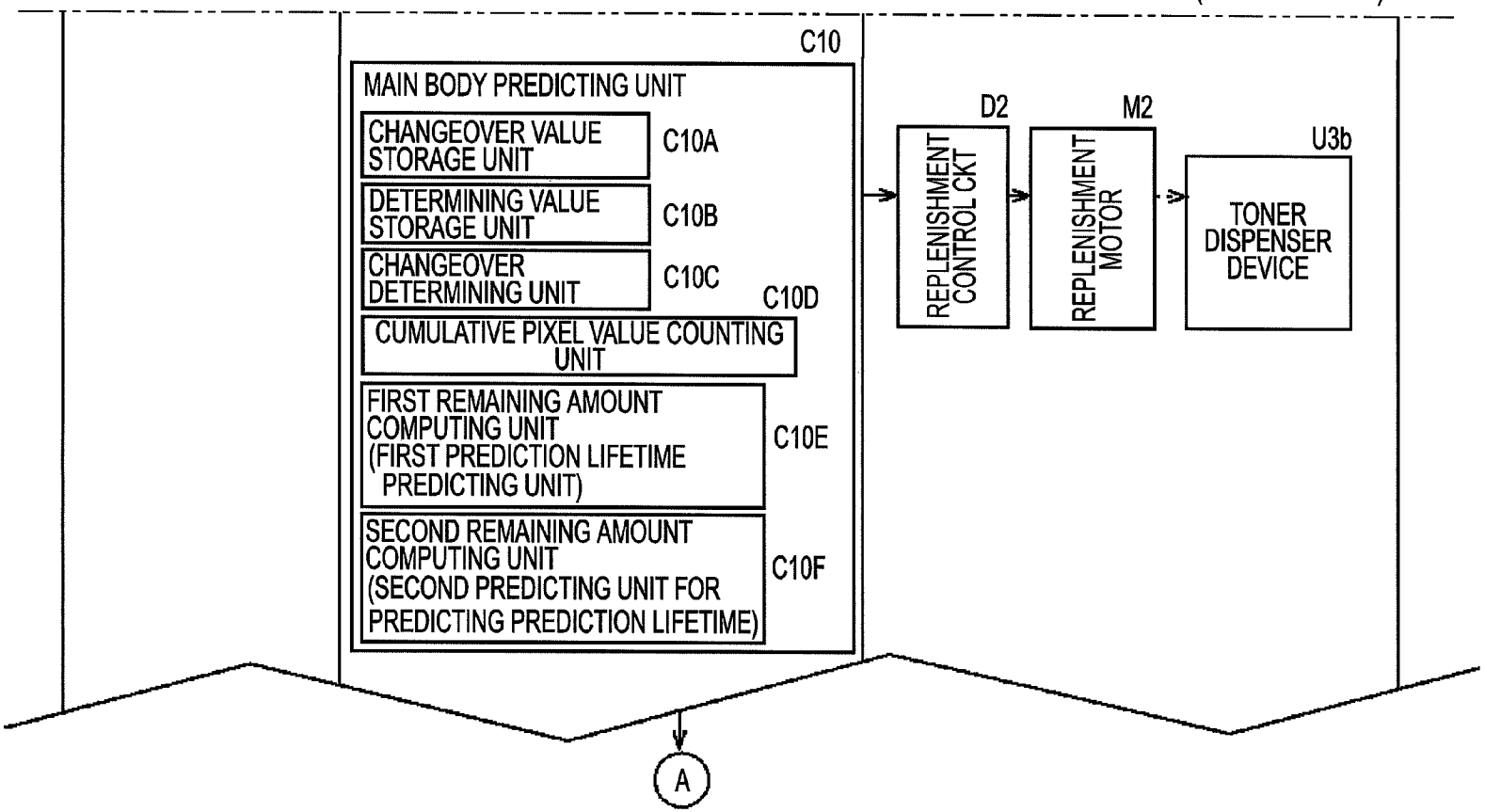

(FIG.14 Continued)
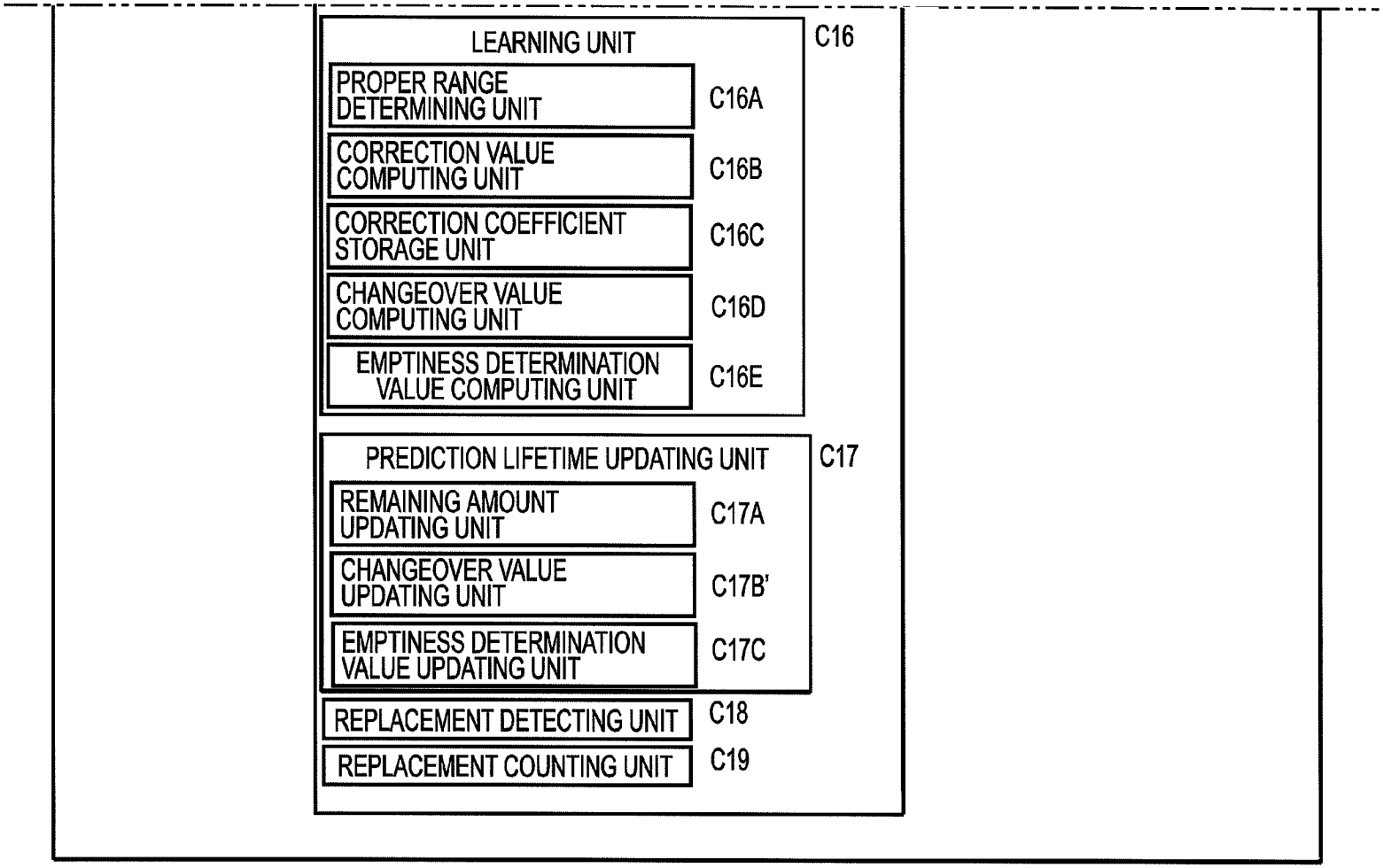

SYSTEM CONNECTION DETERMINATION PROCESSING

CONSUMABLE MANAGEMENT SYSTEM AND IMAGE FORMING APPARATUS

CROSS-REFERENCE TO RELATED APPLICATIONS

This application is based on and claims priority under 35 USC 119 from Japanese Patent Application No. 2009-168341 filed on Jul. 17, 2009.

BACKGROUND

Technical Field

The present invention relates to a consumable management system and an image forming apparatus.

SUMMARY

According to an aspect of the invention, there is provided an image forming apparatus including: a predicting unit that predicts a prediction lifetime of a consumable that is detachably mounted in the image forming apparatus, based on consumption information corresponding to an operation of the image forming apparatus; a connection determining unit that determines whether or not the image forming apparatus is connected to a managing apparatus that manages a replacement time of the consumable that is detachably mounted in the image forming apparatus; a consumption information transmitting unit that transmits the consumption information to the managing apparatus located outside the image forming apparatus; a managed lifetime information receiving unit that receives managed lifetime information transmitted from the managing apparatus based on the consumption information; a replacement time determining unit that determines whether or not the replacement time of the consumable has been reached; a learning unit that effects a learning of the prediction lifetime based on the predicted prediction lifetime predicted by the predicting unit and the replacement time determined by the replacement time determining unit; and a prediction lifetime updating unit that, in a case where the image forming apparatus is connected to the managing apparatus, updates the prediction lifetime of the consumable based on the managed lifetime information, and that, in a case where the image forming apparatus is not connected to the managing apparatus, updates the prediction lifetime of the consumable based on the predicted prediction lifetime learned by the learning unit.

BRIEF DESCRIPTION OF THE DRAWINGS

Exemplary embodiments of the present invention will be described in detail based on the following figures, wherein:

FIGS. 5A and 5B are graphs illustrating the relationship between the remaining amount of the toner in the cartridge and the cumulative replenishment time in Example 1 in which the remaining amount is taken as the abscissa and the cumulative replenishment time is taken as the ordinate, in which FIG. 5A is an explanatory diagram of one example illustrating estimated values and actual changes of a plurality of image forming apparatuses, and FIG. 5B is an explanatory diagram of one example in a case where the cumulative replenishment time changes sharply in a state in which the remaining amount has become small

DETAILED DESCRIPTION

Figure 1:
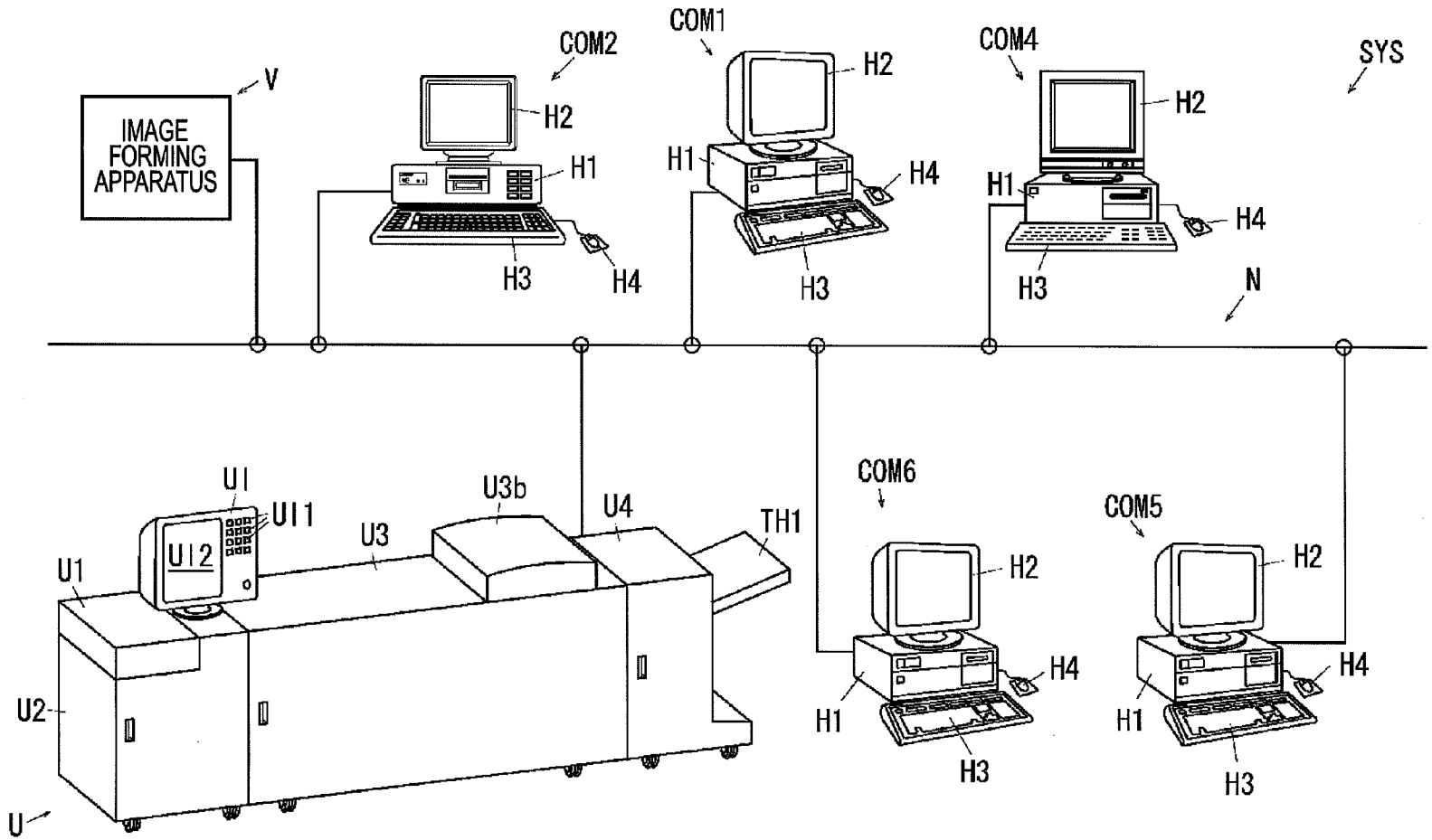
FIG. 1 is an explanatory diagram of an overall image forming system in accordance with Example 1 of the invention.

Next, with reference to the drawings, a description will be given of Examples which are specific examples of an embodiment of the present invention. However, the present invention is not limited to the following Examples.

It should be noted that, to facilitate an understanding of the following description, it is assumed that a front-back direction is set as an X-axis direction, a left-right direction as a Y-axis direction, and a vertical direction as a Z-axis direction, and that directions or sides indicated by arrows X, −X, Y, −Y, Z and −Z are respectively set as front, rear, right, left, upper, and lower directions and front, rear, right, left, upper, and lower sides.

In addition, it is assumed that, in the drawings, a circle (○) with a dot (•) depicted therein means an arrow which is oriented from the reverse side to the obverse side of the plane of the drawing, and that a circle (○) with a cross (x) depicted therein means an arrow which is oriented from the reverse side to the obverse side of the plane of the drawing.

It should be noted that, in the following description with reference to the drawings, illustrations of members other than those necessary for the description are omitted for facilitating an understanding.

EXAMPLE 1

FIG. 1 is an explanatory diagram of an overall image forming system in accordance with Example 1 of the invention.

In FIG. 1, an image forming system SYS as an example of a consumable management system in accordance with Example 1 of the invention has a network N as an example of an information communication line network. Connected to the network N are a management server COM1 as an example of a managing apparatus for managing the time of replacement of consumables of image forming apparatuses; an image information transmission terminal COM2 for transmitting image information for users to print; other terminals COM4, COM5, and COM6; a copier U as an image forming apparatus in accordance with Example 1 of the invention for performing printing on the basis of image information transmitted from the respective terminals COM1 to COM6; and other image forming apparatuses V, and these units and apparatuses are capable of transmitting and receiving information between each other.

The terminals COM1 to COM6 are constituted by computer apparatuses as examples of information processors, and are each constituted by an apparatus body H1, a display H2 as an example of a display unit, a keyboard H3 and a mouse H4 as examples of input devices, an unillustrated hard disk drive as an example of an information storage device, and the like. A program for controlling the basic operation of the computer apparatus, i.e., software, is incorporated in the terminals COM1 to COM6. The incorporated software includes basic software, i.e., so-called an operating system, application programs such as word processing software for documentation, graphics software, and software for e-mail transmission and reception, and printer drivers which are examples of software for controlling the respective image forming apparatuses U and V.

Description of Image Forming Apparatus of Example 1

Figure 2:
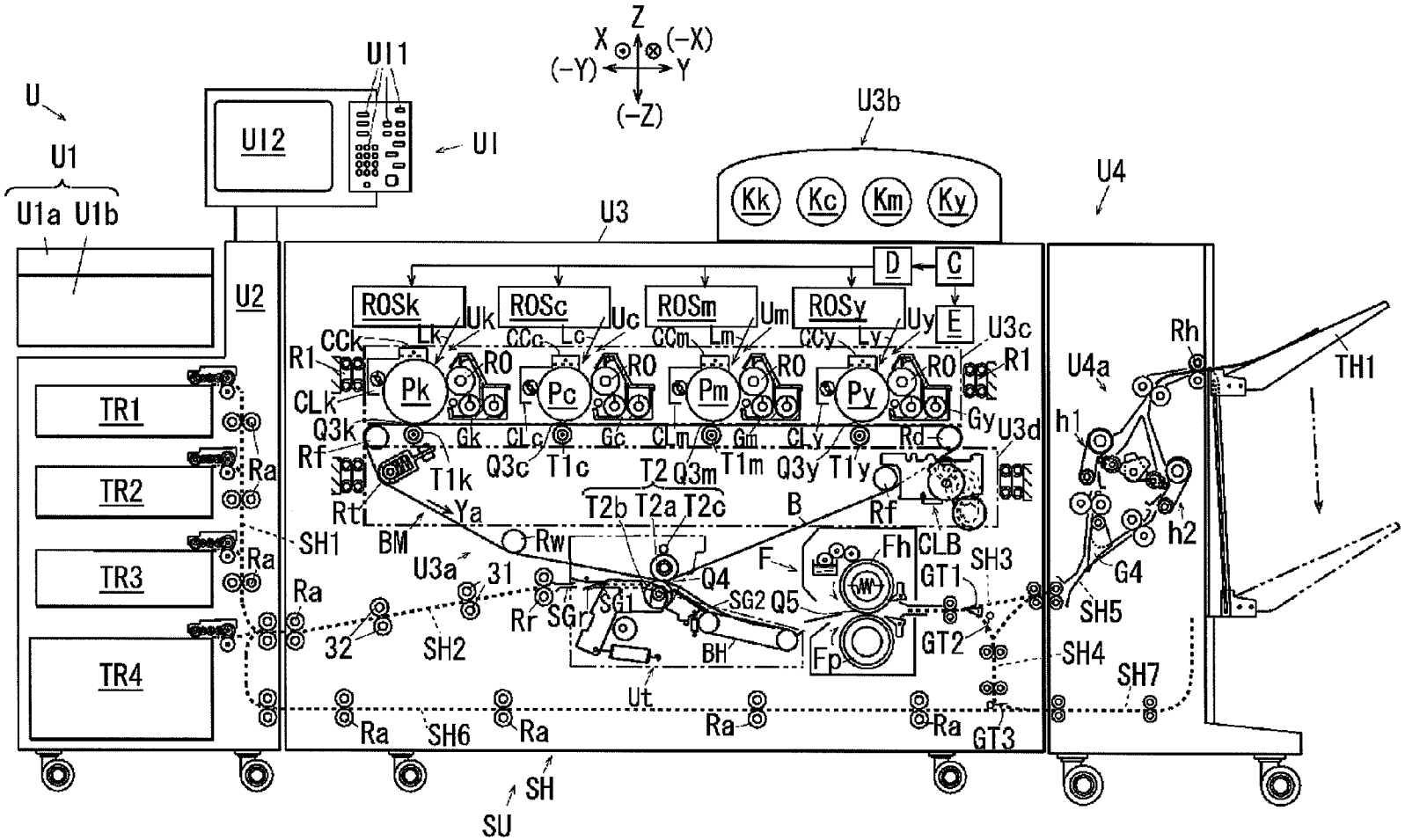
FIG. 2 is an explanatory diagram of an overall image forming apparatus in accordance with Example 1 of the invention.

FIG. 2 is an explanatory diagram of an overall image forming apparatus in accordance with Example 1 of the invention.

In FIGS. 1 and 2, the image forming apparatus U includes a user interface UI as an example of an operating section, an image input device U1 as an example of an image information input device, a sheet supplying device U2, an image forming apparatus body U3, and a sheet processing device U4.

The user interface UI has input buttons UI1 such as a copy start key as an example of a copy start button, a display unit UI2, and the like.

The image input device U1 is constituted by an automatic document transporting device U1*a*, an image scanner UIb as an example of an image reading unit, and the like. In FIG. 2, in the image input device U1, an unillustrated document is read and converted into image information, and is inputted to the image forming apparatus body U3.

The sheet supplying device U2 includes, among others, sheet supplying trays TR1 to TR4 as examples of plural medium accommodating portions and a sheet feeding path SH1 for taking out, one by one, recording sheets S as an example of a medium accommodated in the sheet supplying trays and for transporting them to the image forming apparatus body U3.

In FIG. 2, the image forming apparatus body U3 has, among others, an image recording section U3*a* for recording an image on the recording sheet S transported from the sheet supplying device U2; a toner dispenser device U3*b* as an example of a developer replenishing device; and a sheet transport path SH2, a sheet discharge path SH3, a sheet inverting path SH4, and a sheet circulation path SH6 as examples of transport paths. It should be noted that the image recording section U3*a* will be described later.

In addition, the image forming apparatus body U3 has a controller C as an example of a control unit; a laser driving circuit D as an example of a latent image forming circuit which is controlled by the controller C; a power supply circuit E,E and the like which are controlled by the controller C. The laser driving circuit D whose operation is controlled by the controller C outputs laser driving signals according to image data of Y (yellow), M (magenta), C (cyan), and K (black) inputted from the image input device U1 to latent image forming devices ROSy, ROSm, ROSc, and ROSk of respective colors at predetermined timings.

Below the latent image forming devices ROSy, ROSm, ROSc, and ROSk of the respective colors, an upper drawer U3*c* as an example of a drawing member for an image forming unit is supported movably by a left-right pair of guide members R1 between a drawn position where the upper drawer U3*c* is drawn to the front of the image forming apparatus body U3 and an installed position where it is installed in the image forming apparatus body U3.

In FIG. 2, an image holder unit Uk of the K color has a photoconductor Pk, a charger CCk as an example of a charging device, and a cleaner CLk as an example of a cleaner for the image holder. Further, image holder units Uy, Um, and Uc of the other colors Y, M, and C also respectively have photoconductors Py, Pm, and Pc as examples of image holders, chargers CCy, CCm, and CCc and cleaners CLy, CLm, and CLc. It should be noted that, in Example 1, the photoconductor Pk of the K color whose frequency of use is high and whose amount of surface wear is large is constructed to be larger in diameter than the photoconductors Py, Pm, and Pc of the other colors, and is adapted to rotate at high speed and is provided with a long service life.

Visible image forming members Uy+Gy, Um+Gm, Uc+Gc, and Uk+Gk are respectively constituted by the aforementioned image holder units Uy, Um, Uc, and Uk and developing devices Gy, Gm, Gc, and Gk each having a developing roll R0. The image holder units Uy, Um, Uc, and Uk and the developing devices Gy, Gm, Gc, and Gk are detachably installed in the upper drawer U3*c*.

In FIG. 2, after the photoconductors Py, Pm, Pc, and Pk are uniformly charged by the charging devices CCy, CCm, CCc, and CCk, respectively, latent electrostatic images are formed on their surfaces by laser beams Ly, Lm, Lc, and Lk serving as examples of latent-image writing light and outputted from the latent image forming devices ROSy, ROSm, ROSc, and ROSk. The latent electrostatic images on the surfaces of the photoconductors Py, Pm, Pc, and Pk are developed as toner images of the colors of Y (yellow), M (magenta), C (cyan), and K (black) by the developing devices Gy, Gm, Gc, and Gk.

Toner cartridges Ky, Km, Kc, and Kk, which are examples of developer accommodating containers with developers of the respective colors accommodated therein and serve as examples of consumables, are detachably supported in the aforementioned toner dispenser device U3*b*.

In addition, the toner dispenser device U3*b* of Example 1 is provided with an unillustrated emptiness detection sensor as an example of an emptiness detecting member for detecting whether or not the developers in the toner cartridges Ky to Kk have become empty by detecting the presence or absence of the inflow of the developers from the toner cartridges Ky to Kk.

Therefore, with the copier U in accordance with Example 1, when the developers are consumed in the developing devices Gy to Gk in conjunction with the image forming operation, the toner dispenser device U3*b* is operated to replenish the developers from the respective toner cartridges Ky to Kk into the respective developing devices Gy to Gk. It should be noted that, in the developing devices Gy to Gk in accordance with Example 1, two-component developers each including a toner and a carrier are used. Further, in Example 1, consumption amounts of the toners, i.e., replenishment amounts of the toners to be replenished from the toner cartridges Ky to Kk, are derived on the basis of the toner densities of the developing devices Gy to Gk, i.e., increases or decreases of the ratios of the toners, each including the toner and the carrier, with respective to the whole, as well as the numbers of pixels of the latent images formed by the latent image forming devices ROSy, ROSm, ROSc, and ROSk, and the operation time of the toner dispenser device U3*b* corresponding to the replenishment amounts of the toners is derived. Accordingly, as the toner dispenser device U3*b* in accordance with Example 1 is operated only for the derived operation time, the developers in amounts corresponding to the consumed toners by the developing devices Gy to Gk are replenished.

The toner images on the surfaces of the photoconductors Py, Pm, Pc, and Pk are sequentially superimposed and transferred onto an intermediate transfer belt B as an example of an intermediate transfer body in primary transfer regions Q3*y*, Q3*m*, Q3*c*, and Q3*k* by primary transfer rolls T1*y*, T1*m*, T1*c*, and T1*k* as examples of primary transfer devices, and a multicolor image, i.e., a so-called color image, is formed on the intermediate transfer belt B. The color image formed on the intermediate transfer belt B is transported to a secondary transfer region Q4 as an example of an image recording region.

It should be noted that in a case where there is only black image data, only the photoconductor Pk and the developing device Gk of K (black) are used and only a black toner image is formed.

After primary transfer, residual toner on the surfaces of the photoconductors Py, Pm, Pc, and Pk is cleaned by the cleaners CLy, CLm, CLc, and CLk for the image holders.

Below the upper drawer U3*c*, a lower drawer U3*d* as an example of a drawing member for an intermediate transfer body is supported movably between a drawn position where the lower drawer U3*d* is drawn to the front of the image forming apparatus body U3 and an installed position where it is installed in the image forming apparatus body U3. A belt module BM as an example of the intermediate transfer device is supported by the lower drawer U3*d* liftably between a raised position where the belt module BM comes into contact with lower surfaces of the photoconductors Py, Pm, Pc, and Pk and a lowered position where it spaced apart cowardly from the lower surfaces.

The belt module BM has the intermediate transfer belt B, belt supporting rolls Rd, Rt, Rw, Rf, and T2*a* as examples of intermediate transfer body supporting members, and the primary transfer rolls T1*y*, T1*m*, T1*c*, and T1*k*. The belt supporting rolls Rd, Rt, Rw, Rf, and T2*a* include a belt drive roll Rd as an example of a driving member, a tension roll Rt as an example of a tension imparting member, a walking roll Rw as an example of a skew preventing member, plural idler rolls Rf as examples of driven members, and a backup roll T2*a* as an example of a transfer opposing member. Further, the intermediate transfer belt B is supported rotatably movably in the direction of arrow Ya by the belt supporting rolls Rd, Rt, Rw, Rf, and T2*a*.

A secondary transfer unit Ut is disposed below the backup roll T2*a*, and the secondary transfer unit Ut has a secondary transfer roll T2*b* as an example of a secondary transfer member. The secondary transfer roll T2*b* is disposed in such a manner as to be moved away from and into contact with the backup roll T2*a* with the intermediate transfer belt B located therebetween. The secondary transfer region Q4 as an example of an image recording region is formed by a region where the secondary transfer roll T2*b* comes into contact with the intermediate transfer belt B. In addition, a contact roll T2*c* as an example of a contact member for voltage application abuts against the backup roll T2*a*, and a secondary transfer device T2 is constituted by the rolls T2*a* to T2*c*.

A secondary transfer voltage of the same polarity as the charging polarity of the toner is applied to the contact roll T2*c* at a timing set in advance by the power supply circuit E which is controlled by the controller C.

The sheet transport path SH2 as an example of a transport path is arranged below the belt module B. The recording sheet S fed from the sheet supplying device U2 is transported from the sheet feeding path SH1 to the sheet transport path SH2 by transport rolls Ra as examples of transporting members. Further, the recording sheet S is passed through a medium guide member SGr and a pre-transfer medium guide member SG1 and is transported to the secondary transfer region Q4 by registration rolls Rr as examples of timing adjusting members to coincide with the transfer of the toner image to the secondary transfer region Q4.

It should be noted that the medium guide member SGr together with the registration rolls Rr is fixed to the image forming apparatus body U3.

The toner image on the intermediate transfer belt B is transferred onto the recording sheet S by the secondary transfer device T2 at the time of passing through the secondary transfer region Q4. It should be noted that, in the case of a full-color image, toner images which have been primarily transferred overlappingly onto the surface of the intermediate transfer belt B are secondarily transferred collectively onto the recording sheet S.

The intermediate transfer belt B after the secondary transfer is cleaned by a belt cleaner CLB as an example of an intermediate transfer body cleaner. It should be noted that the secondary transfer roll T2*b* and the belt cleaner CLB are supported in such a manner as to be moved away from and into contact with the intermediate transfer belt B.

A transfer device T1+B+T2+CLB for transferring the images on the surfaces of the photoconductors Py to Pk onto the recording sheet S is constituted by the primary transfer rolls T1*y*, T1*m*, T1*c*, and T1*k*, the intermediate transfer belt B, the secondary transfer device T2, the belt cleaner CLB, and the like.

The image recording section U3*a* in accordance with Example 1 is constituted by the visible image forming members Uy+Gy to Uk+Gk and the transfer device T1+B+T2+CLB.

The recording sheet S with the toner image secondarily transferred thereon is passed through a post-transfer medium guide member SG2 and onto a sheet transporting belt BH as an example of a pre-fixation medium transporting member, and is transported to a fixing device F. The fixing device F has a heating roll Fh as an example of a heating fixing member and a pressure roll Fp as an example of a pressurizing fixing member, and a fixing region Q5 is formed by a region where the heating roll Fh and the pressure roll Fp are brought into pressure contact with each other.

The toner image on the recording sheet S is fixed by the fixing device F when it passes through the fixing region Q5. A transport path switching member GT1 is provided on the downstream side of the fixing device F. The transport path switching member GT1 selectively switches between the sheet discharge path SH3 and the sheet inverting path SH4 for the recording sheet S transported on the sheet transport path SH2 and heated and fixed in the fixing region Q5. The sheet S transported to the sheet discharge path SH3 is transported to a sheet transport path SH5 of the sheet processing device U4.

A curl correcting device U4*a* as an example of a curling tendency correcting device is disposed midway in the sheet transport path SH5, and a switching gate as an example of a transport path switching member is disposed at the sheet transport path SH5. The switching gate G4 transports the recording sheet S transported from the sheet transport path SH3 of the image forming apparatus body U3 to either side of a first curl correcting member h1 and a second curl correcting member h2 according to the direction of its curve, i.e., its so-called curl. The recording sheet S transported to the first curl correcting member h1 or the second curl correcting member h2 has its curl corrected at the time of passing the curl correcting member. The recording sheet S whose curl has been corrected is discharged from a discharge roll Rh as an example of a discharging member to a discharge tray TH1 as an example of a discharging portion in a state in which the image fixing surface of the sheet S faces upward, i.e., in a so-called face-up state.

The recording sheet S, which has been transported to the sheet inverting path SH4 side of the image forming apparatus body U3 by the transport path switching member GT1, passes through a mylar gate G2 made of a sheet-like member in a pushing-aside manner, and is transported to the sheet inverting path SH4 of the image forming apparatus body U3.

The sheet circulation path SH6 and a sheet inverting path SH7 of the sheet processing device U4 are connected to a downstream end of the sheet inverting path SH4 of the image forming apparatus body U3, and a mylar gate G3 is disposed at that connecting portion as well. The sheet which has passed through the switching gate GT1 and has been transported to the sheet transport path SH4 passes through the mylar gate G3 and is transported to the sheet inverting path SH7 side. In a case where duplex printing is performed, the recording sheet S, which has been transported on the sheet inverting path SH4, temporarily passes as is through the mylar gate G3, is transported to the sheet inverting path SH7, and is then transported in the reverse direction, i.e., is switched back. Hence, the switched-back recording sheet S has its transporting direction restricted by the mylar gate GT3, and is transported to the sheet circulation SH6 side. The recording sheet S transported to the sheet circulation path SH6 passes along the sheet feeding path SH1, and is resent to the transfer region Q4.

A sheet inverting path SH4+SH6+SH7 as an example of an inverting path in accordance with Example 1 is constituted by the sheet inverting path SH4, the sheet circulation path SH6, the sheet inverting path SH7, and the like.

Meanwhile, if the recording sheet S transported along the sheet inverting path SH4 is switched backed before the trailing end of the recording sheet S passes through the mylar gate GT3 after passing through the mylar gate GT2, the transporting direction of the recording sheet S is restricted by the mylar gate GT2, and the recording sheet S with its obverse and reverse sides inverted is transported to the sheet transport path SH5. After the curl of the recording sheet S with its obverse and reverse sides inverted is corrected by the curl correcting device U4*a*, the recording sheet S can be discharged to the sheet discharge tray TH1 of the sheet processing device U4 in a state in which the image fixing surface of the sheet S faces downward, i.e., in a so-called face-down state.

A sheet transport path SH is constituted by the elements denoted by the reference numerals SH1 to SH7. In addition, a sheet transporting device SU as an example of a medium transporting device is constituted by the elements denoted by the reference numerals TR1 to TR4, SH, Ra, Rr, RH, SGr, SG1, SG2, BH, GT1 to GT3, C, and the like.

Description of the Control Unit of Example 1

Description of the Control Unit of the Image Forming Apparatus

Figure 3:
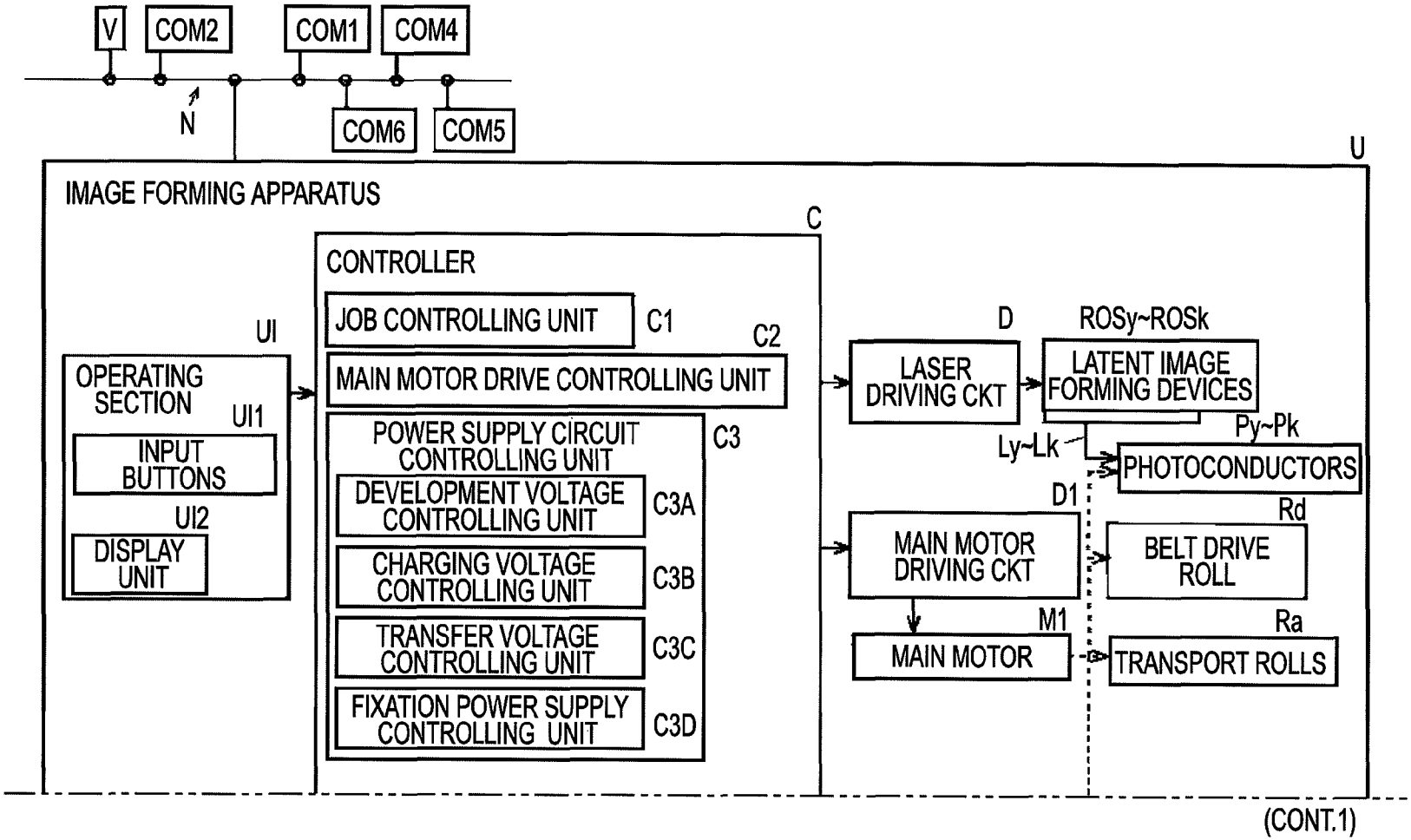
FIG. 3 is a block diagram illustrating the functions of a controlling section of the image forming apparatus in accordance with Example 1 of the invention.

FIG. 3 is a block diagram illustrating the functions of a controlling section of the image forming apparatus in accordance with Example 1 of the invention.

Figure 4:
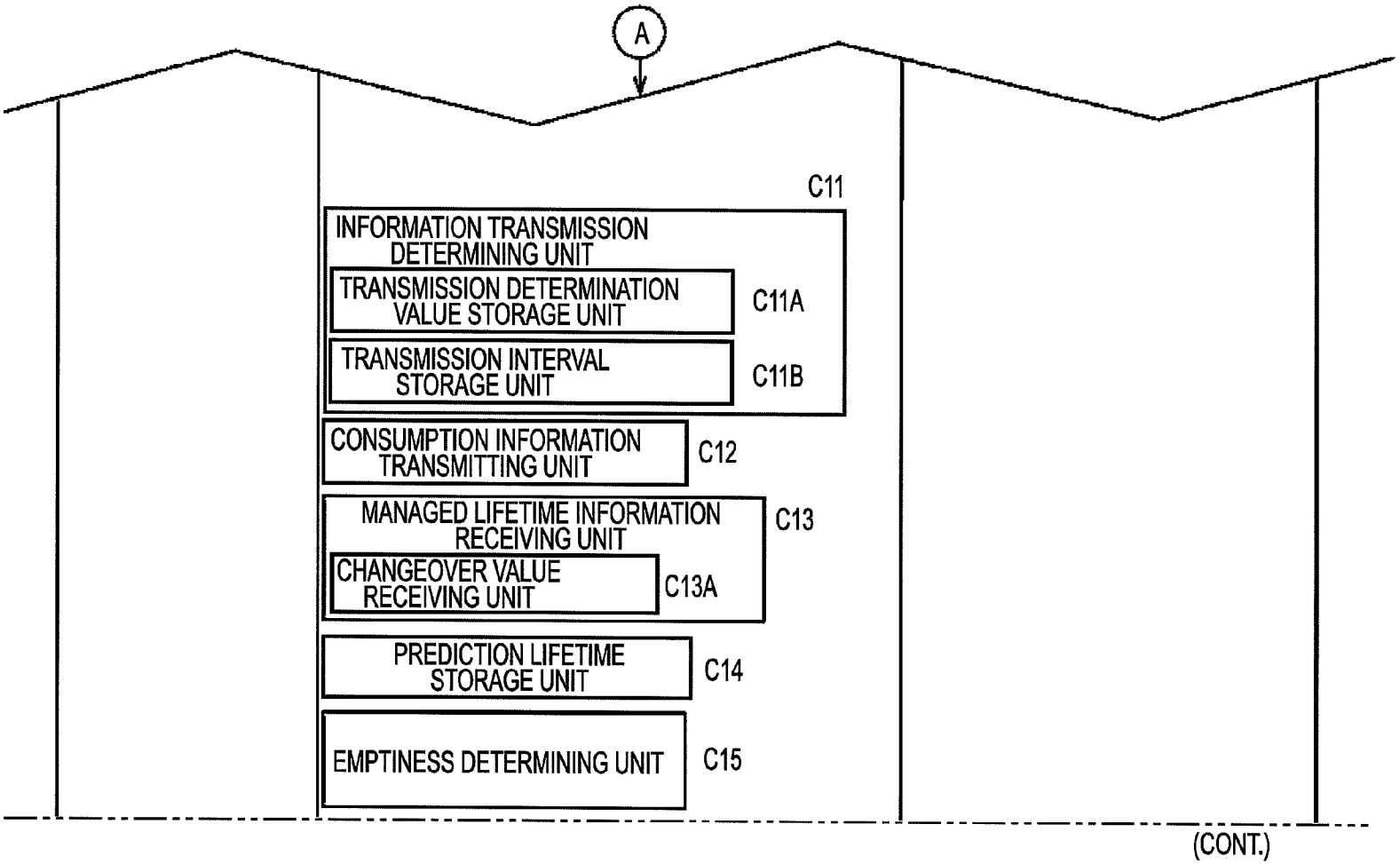
FIG. 4 a block diagram illustrating the functions of the controlling section of the image forming apparatus in accordance with Example 1 of the invention, and is a continuation from FIG. 3.

FIG. 4 a block diagram illustrating the functions of the controlling section of the image forming apparatus in accordance with Example 1 of the invention, and is a continuation from FIG. 3.

In FIGS. 3 and 4, the controller C of the image forming apparatus U of Example 1 is constituted by a small-size information processor, i.e., a so-called microcomputer, and includes, among others, I/O devices for effecting the inputting and outputting of signals with respect to an external circuit and for effecting such as adjustment of an input/output signal level; a ROM in which a program for executing necessary processing, data, and the like are stored; a RAM and a HDD for temporarily storing necessary data; a CPU for performing processing corresponding to the programs stored in the ROM and the HDD; and a clock oscillator. The controller C is able to realize various functions by executing the program stored in the ROM.

(Signal Input Elements Connected to the Controller C)

Output signals from signal output elements such as the operating section UI, an emptiness detection sensor SN0, toner density sensors SN1, and the like are inputted to the controller C.

The operating section UI has the various input buttons UI1 including such as a power supply button for turning on and off the power supply of the copier U and arrow keys as examples of direction input buttons, as well as the display unit UI2.

The emptiness detection sensor SN0 is provided in the toner dispenser device U3*b* to detect whether or not the developers in the toner cartridges Ky to Kk have become empty.

The toner density sensors SN1 are provided in the respective developing devices Gy to Gk to detect the toner densities in the developing devices Gy to Gk.

(Controlled Elements Connected to the Controller C)

The controller C outputs control signals of the following controlled elements D, D1, D2, and E.

D: Laser Driving Circuit

The laser driving circuit D controls the latent image forming devices ROSy to ROSk to form latent images on the surfaces of the photoconductors Py to Pk.

D1: Main Motor Driving Circuit

The main motor driving circuit D1 as an example of a main driving source driving circuit drives a main motor M1 as an example of a main driving source to rotatively drive the photoconductors Py to Py and the like.

D2: Replenishment Control Circuit

The replenishment control circuit D2 drives a replenishment motor M2 as an example of a replenishing driving source to operate the toner dispenser device U3*b*.

E: Power Supply Circuit

The power supply circuit E includes a power supply circuit E1 for development, a power supply circuit E2 for charging, a power supply circuit E3 for transfer, a power supply circuit E4 for fixation, and the like.

E1: Power Supply Circuit for Development

The power supply circuit E1 for development applies a development voltage to the development rolls R0 of the developing devices Gy to Gk.

E2: Power Supply Circuit for Charging

The power supply circuit E2 for charging applies a charging voltage to the chargers CCy to CCk to charge the surfaces of the photoconductors Py to Pk.

E3: Power Supply Circuit for Transfer

The power supply circuit E3 for transfer applies a transfer voltage to the transfer rolls T1*y* to T1*k* and T2*b*.

E4: Power Supply Circuit for Fixation

The power supply circuit E4 for fixation supplies power to the heating roll Fh of the fixing device F for heating a heater.

(Functions of the Controller C)

The controller C has the functions of outputting control signals to the respective controlled elements by executing processing corresponding to input signals from the signal output elements. Namely, the controller C has the following functions.

C1: Job Controlling Unit

A job controlling unit C1 as an example of an image formation controlling unit controls the operation of such as the chargers CCy to CCk, the transfer rolls T1*y* to T1*k* and T2*b*, and the fixing device F to execute jobs as examples of image formation operation.

C2: Main Motor Drive Controlling Unit

A main motor drive controlling unit C2 as an example of a main driving source drive controlling unit controls the driving of the main motor M1 through the main motor driving circuit D1 to control the driving of such as the developing devices Gy to Gk, the heating roll Fh of the fixing device F, and the transport rolls Ra.

C3: Power Supply Circuit Controlling Unit

A power supply circuit controlling unit C3 includes a development voltage controlling unit C3A, a charging voltage controlling unit C3B, a transfer voltage controlling unit C3C, and a fixation power supply controlling unit C3D, and controls the operation of the power supply circuit E so as to control the voltage and power supply to the respective members.

C3A: Development Voltage Controlling Unit

The development voltage controlling unit C3A controls the power supply circuit E1 to control the application of the development voltage to the development rolls R0 of the developing devices Gy to Gk.

C3B: Charging Voltage Controlling Unit

The charging voltage controlling unit C3B controls the power supply circuit E2 for charging to control the application of the charging voltage to the chargers CCy to CCk.

C3C: Transfer Voltage Controlling Unit

The transfer voltage controlling unit C3C controls the power supply circuit E3 for transfer to control the transfer voltage to be applied to the transfer rolls T1Y to T1*k* and T2*b*.

C3D: Fixation Power Supply Controlling Unit

The fixation power supply controlling unit C3D controls the power supply circuit E4 for fixation to control the turning on and off of the fixing device F so as to control the fixation temperature.

C4: Latent Image Forming Unit

A latent image forming unit C4 controls the latent image forming devices ROSy to ROSk through the laser driving circuit D to form latent electrostatic images on the surfaces of the photoconductors Py to Pk.

C5: Display Controlling Unit

A display controlling unit C5 controls the display of the display unit UI2 of the operating section UI in correspondence with the state of the copier U.

C6: Connection Determining Unit

A connection determining unit C6 has a main body prediction flag FL1, and determines whether or not the copier U is connected to the management server COM1 through the network N.

FL1: Main Body Prediction Flag

The main body prediction flag FL1 has an initial value of "0". The main body prediction flag FL1 is set to "0" when connected to the management server COM1, and is set to "1" when not connected to the management server COM1.

C7: Replenishment Amount Computing Unit

A replenishment amount computing unit C7 as an example of a consumption amount computing unit includes a pixel counting unit C7A, a density detecting unit C7B, and a replenishment time calculating unit C7C, and computes replenishment amounts corresponding to consumption amounts of the toner cartridges Ky to Kk as examples of consumables.

C7A: Pixel Counting Unit

The pixel counting unit C7A as an example of a pixel counting unit counts the numbers of latent images formed by the latent image forming devices ROSy to ROSk, i.e., so-called pixel values p1.

C7B: Density Detecting Unit

The density detecting unit C7B detects toner densities in the developing devices Gy to Gk on the basis of detection signals from the toner density sensors SN1.

C7C: Replenishment Time Calculating Unit

The replenishment time calculating unit C7C calculates replenishment amounts on the basis of consumption amounts of the toners in the developing devices Gy to Gk. The replenishment time calculating unit C7C of Example 1 calculates toner consumption amounts in the developing devices Gy to Gk, i.e., replenishment amounts to be replenished, and calculates a replenishment time t1 which is the operation time of the toner dispenser device U3*b* corresponding to the replenishment amounts. It should be noted that since methods for deriving the replenishment time t1 on the basis of the pixel value p1 or the toner density are described in such as Patent Documents 2 and 3, and various conventionally known methods can be adopted, a detailed description thereof will be omitted.

C8: Replenishing Device Controlling Unit

A replenishing device controlling unit C8 controls the toner dispenser device U3*b* through the replenishment control circuit D2 to control the replenishment of the toners from the toner cartridges Ky to Kk to the developing devices Gy to Gk. The replenishing device controlling unit C8 in accordance with Example 1 effects toner replenishment by operating the toner dispenser device U3*b* for the replenishment time t1 derived by the replenishment amount computing unit C7.

C9: Consumption Information Storage Unit

A consumption information storage unit C9 includes a cumulative time counting unit C9A for counting a cumulative replenishment time to which is a cumulative value of the replenishment time t1 after replacement of the toner cartridges Ky to Kk, as well as a total pixel counting unit C9B for counting a total pixel value pa which is a cumulative value of the pixel value p1 after the replacement of the toner cartridges Ky to Kk. The consumption information storage unit C9 stores consumption information which is information concerning the consumption of the toner cartridges Ky to Kk as examples of the consumables. In Example 1, information stored as the consumption information includes, in addition to the cumulative replenishment time ta and the total pixel value pa, the cumulative number of prints, an average image density of formed images, an average number of continuous prints, a monochromatic print/multi-color print ratio, the frequency of the size of the medium used, the working environment such as the temperature and humidity, a district of use, and the like.

Figure 5A:
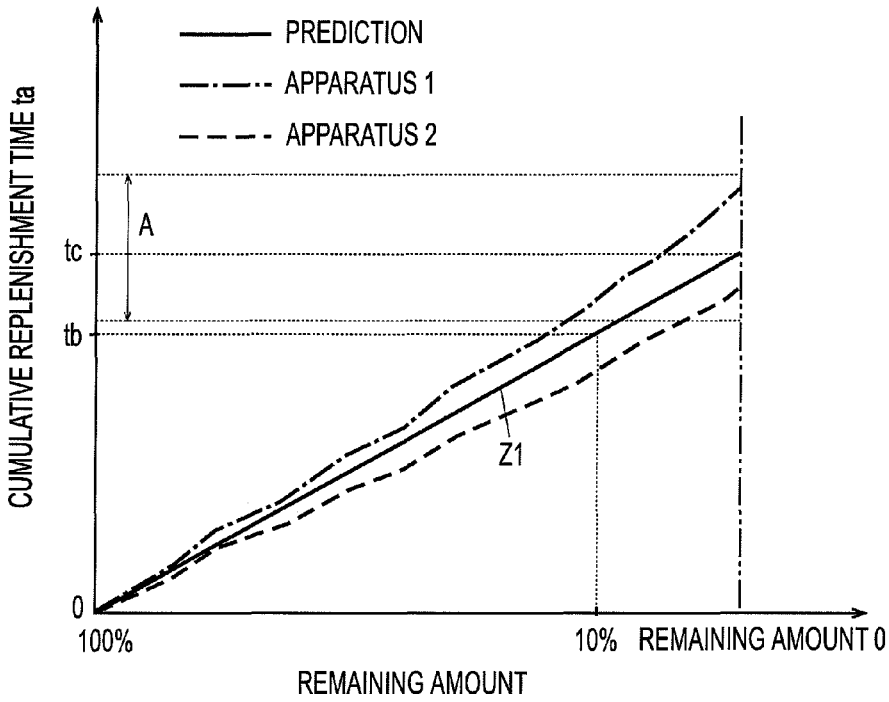
Figure 5B:
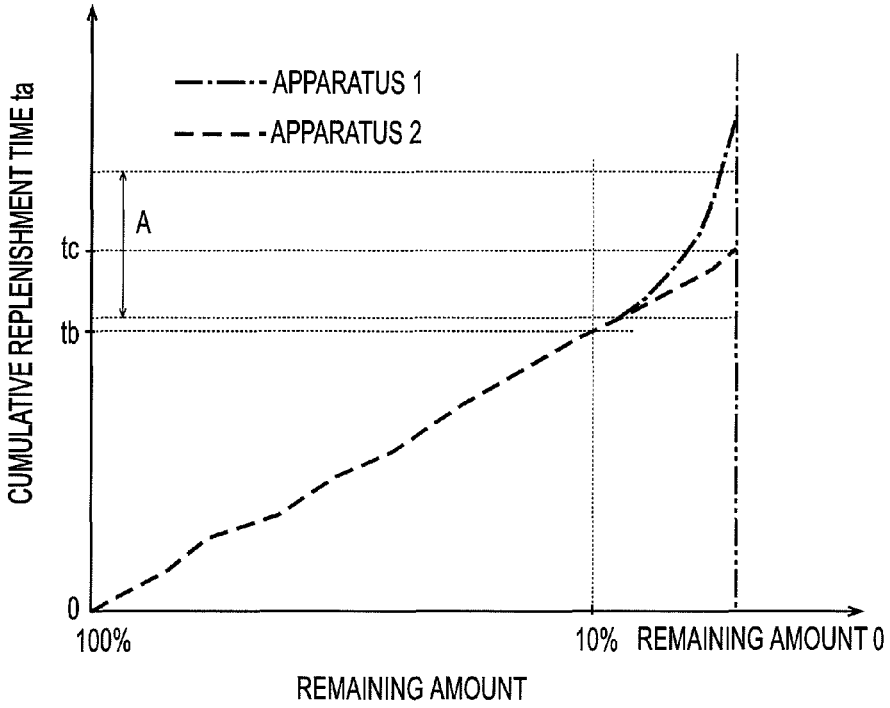

FIGS. 5A and 5B are graphs illustrating the relationship between the remaining amount of the toner cartridge and the cumulative replenishment time in Example 1 in which the remaining amount is taken as the abscissa and the cumulative replenishment time is taken as the ordinate. FIG. 5A is an explanatory diagram of one example illustrating estimated values and actual changes of plural image forming apparatuses, and FIG. 5B is an explanatory diagram of one example in a case where the cumulative replenishment time changes sharply in a state in which the remaining amount has become small.

C10: Main Body Predicting Unit

A main body predicting unit C10 as an example of an apparatus-side predicting unit includes a changeover value storage unit C10A; a determining value storage unit C10B; a changeover determining unit C10C; a cumulative pixel value counting unit C10D as an example of a cumulative pixel counting unit; a first remaining amount computing unit C10E as an example of a first prediction lifetime predicting unit; and a second remaining amount computing unit C10F as an example of a second predicting unit for predicting prediction lifetime. The main body predicting unit C10 predicts the prediction lifetime of the toner cartridges Ky to Kk on the basis of the cumulative replenishment time ta as an example of the driving time of the copier U in a case where the copier U is not connected to the management server COM1.

In FIGS. 5A and 5B, the main body predicting unit 10 in accordance with Example 1 predicts as the prediction lifetime of the toner cartridges Ky to Kk either one of a first predicted remaining amount Z1 as an example of a first prediction lifetime predicted on the basis of the cumulative replenishment time ta as an example of first consumption information corresponding to the operation of the copier U and a second predicted remaining amount Z2 as an example of a second prediction lifetime predicted on the basis of a below-described cumulative pixel value pb as second consumption information. In the main body predicting unit C10 of Example 1, in a case where a remaining amount Z of each of the toner cartridges Ky to Kk is greater than a remaining 10% with respect to a full condition, the first predicted remaining amount Z1 is set as the predicted remaining amount Z of each of the toner cartridges Ky to Kk, and if it is equal to or less than the remaining 10%, the second predicted remaining amount Z2 is set as the predicted remaining amount Z of each of the toner cartridges Ky to Kk.

C10A: Changeover Value Storage Unit

The changeover value storage unit C10A stores at least one of the cumulative replenishment time ta and the total pixel value p1 and a remaining 10% determination value tb as an example of a changeover value as a threshold for changing over the prediction of the prediction lifetime, i.e., the remaining amount Z, of each of the toner cartridges Ky to Kk from one of the first predicted remaining amount Z1 and the second predicted remaining amount Z2 to the other one thereof. The changeover value storage unit C10A in accordance with Example 1 stores the remaining 10% determination value tb for determining whether or not the remaining amount Z of each of the toner cartridges Ky to Kk is the remaining 10% with respect to the full condition as a threshold for changing over the prediction of the remaining amount Z from the first predicted remaining amount Z1 to the second predicted remaining amount Z2 on the basis of the cumulative replenishment time ta.

C10B: Determination Value Storage Unit

The determination value storage unit C10B stores at least one of the cumulative replenishment time ta and the total pixel value p1 and an emptiness determination time tc as an example of a determination value for determining a case where the service life of each of the toner cartridges Ky to Kk is predicted to expire, i.e., the toner cartridge is predicted to become empty. The determination value storage unit C10B in accordance with Example 1 stores the emptiness determination time tc as a determination value corresponding to a state in which the remaining amount Z of each of the toner cartridges Ky to Kk becomes 0%, i.e., the toner cartridge becomes empty, on the basis of the cumulative replenishment time ta.

C10C: Changeover Determining Unit

On the basis of the cumulative replenishment time ta and the remaining 10% determination value tb, the changeover determining unit C10C determines which of the first predicted remaining amount Z1 and the second predicted remaining amount Z2 is to be set as the predicted remaining amount Z of each of the toner cartridges Ky to Kk. The changeover determining unit C10C in accordance with Example 1 sets the first predicted remaining amount Z1 as the predicted remaining amount Z if the remaining amount Z is greater than the remaining 10%, and sets the second predicted remaining amount Z2 as the predicted remaining amount Z if it becomes equal to or less than the remaining 10%.

C10D: Cumulative Pixel Value Counting Unit

In the case where the remaining amount of each of the toner cartridges Ky to Kk has become equal to or less than 10%, the cumulative pixel value counting unit C10D counts the cumulative pixel value pb which is a cumulative value of the pixel value pl after when the remaining amount has become equal to or less than 10%.

C10E: First Remaining Amount Computing Unit

The first remaining amount computing unit C10E predicts the first predicted remaining amount Z1 on the basis of the cumulative replenishment time ta. The first remaining amount computing unit C10E in accordance with Example 1 computes the first predicted remaining amount Z1 from the following Formula (1) on the basis of the cumulative replenishment time ta and the emptiness determination time tc corresponding to the cumulative replenishment time ta at a time when each of the toner cartridges Ky to Kk is predicted to become empty.

$$Z1[\%]=(1-ta/tc)\times 100 \qquad \text{Formula (1)}$$

C10F: Second Remaining Amount Computing Unit

The second remaining amount computing unit C10F predicts the second predicted remaining amount Z2 on the basis of the cumulative pixel value pb. The second remaining amount computing unit C10F in accordance with Example 1 computes the second predicted remaining amount Z2 from the following Formula (2) on the basis of the cumulative pixel value pb and an emptiness determination pixel value pc corresponding to the cumulative pixel value pb after the remaining amount of each of the toner cartridges Ky to Kk has reached the remaining 10% and until each of the toner cartridges Ky to Kk is predicted to become empty.

$$Z2[\%]=(0.1-pb/pc)\times 100 \qquad \text{Formula (2)}$$

C11: Information Transmission Determining Unit

In FIG. 4, an information transmission determining unit C11 has a transmission determination value storage unit C11A and a transmission interval storage unit C11B, and determines whether or not a time for transmitting consumption information to the connected management server COM1 has arrived.

C11A: Transmission Determination Value Storage Unit

The transmission determination value storage unit C11A stores a transmission determination value td for determining on the basis of the cumulative replenishment time ta whether or not consumption information is to be sent.

C11B: Transmission Interval Storage Unit

The transmission interval storage unit C11B stores a transmission interval te which is an interval of transmission of the consumption information. The transmission interval te in accordance with Example 1 is set in advance through experiments and the like, and is set to a value corresponding to the cumulative replenishment time ta equivalent to 10% of the toner consumption amount.

C12: Consumption Information Transmitting Unit

In the case where the copier U is connected to the management server COM1, a consumption information transmitting unit C12 transmits the consumption information on the toner cartridges Ky to Kk to the management server COM1. The consumption information transmitting unit C12 in accordance with Example 1 transmits the consumption information when the time of transmission of the consumption information by the information transmission determining unit C11 has arrived.

C13: Managed Lifetime Information Receiving Unit

A managed lifetime information receiving unit C13 has a changeover value receiving unit C13A, which receives managed lifetime information transmitted from the management server COM1 in response to the consumption information transmitted from the consumption information transmitting unit C12.

C13A: Changeover Value Receiving Unit

The changeover value receiving unit C13A receives management changeover information, i.e., information on a correction value tf which is used for deriving the remaining 10% determination value tb as an example of a changeover value transmitted from the management server COM1, in response to the consumption information transmitted by the consumption information transmitting unit C12.

C14: Prediction Lifetime Storage Unit

A prediction lifetime storage unit C14 as an example of a lifetime storage unit stores a predicted value of the remaining amount Z, which is the predicted prediction lifetime of each of the toner cartridges Ky to Kk.

C15: Emptiness Determining Unit

On the basis of the detection result of the emptiness detection sensor SN0, the emptiness determining unit C15 determines whether or not each of the toner cartridges Ky to Kk has become empty, i.e., whether or not the time of replacement has been reached.

C16: Learning Unit

A learning unit C16 has a proper range determining unit C16A, a correction value computing unit C16B, a correction coefficient storage unit C16C, a changeover value computing unit C16D, and an emptiness determination value computing unit C16E, and performs the learning of the predicted remaining amount Z on the basis of the predicted remaining amount Z as an example of the prediction lifetime predicted by the main body predicting unit C10 and the replacement time determined by the emptiness determining unit C15. The learning unit C16 in accordance with Example 1 performs the learning of the emptiness determination time tc as an example of a determination value of the predicted remaining amount Z, and also performs the learning of the remaining 10% determination value tb as an example of a changeover value. Namely, the learning unit C16 in accordance with Example 1 performs the learning of the remaining 10% determination value tb and the emptiness determination time tc on the basis of a deviation of the value of the predicted remaining amount Z at the time when the actual remaining amount has reached 0%, to thereby perform learning for the next prediction of the predicted remaining amount Z with high accuracy for each of the toner cartridges Ky to Kk.

C16A: Proper Range Determining Unit

At the time of learning the remaining 10% determination value tb and the emptiness determination time tc, the proper range determining unit C16A determines whether or not the range of the value of the cumulative replenishment time ta is included in a proper range set in advance. A determination is made as to whether or not the range of the cumulative replenishment time ta in the case where each of the toner cartridges Ky to Kk is determined to have become empty is included in a range A having a predetermined range of deviation from the cumulative replenishment time at the time when the remaining amount is predicted to be 0, i.e., from the emptiness determination value tc, as shown in FIG. 5A. Meanwhile, when, as shown in the apparatus 1 in FIG. 5B, the remaining amount in each of the toner cartridges Ky to Kk has become small, and the amount of the developer transported per unit time, i.e., the so-called replenishment rate, becomes small and unstable, there are cases where the driving time of the toner dispenser device U3*b* becomes sharply large in order to allow a toner consumption amount similar to that at a replenishment rate before the decline to be made up for at the declined replenishment rate. However, since learning is carried out on the basis of the cumulative pixel value pb after the remaining 10%, no problem is presented to the learning effect. Accordingly, it is necessary to determine the proper range A such that cases where the replenishment rate declines and the cumulative replenishment time becomes large are also included. If learning is performed based on cases where large errors outside the range of the proper range A are included, the learning effect declines, so that, in Example 1, an arrangement is so provided that learning is not carried out in cases where the cumulative replenishment time to is not included in the proper range A.

C16B: Correction Value Computing Unit

The correction value computing unit C16B computes the correction value tf for correcting the remaining 10% determination value tb and the emptiness determination time tc. The correction value computing unit C16B in accordance with Example 1 derives the correction value tf from the following Formula (3) on the basis of a time conversion count Ct set in advance for converting the pixel value p1 to the replenishment time t1 corresponding to the pixel value p1, the cumulative pixel value pb, and the emptiness determination pixel value pc.

$$tf=(pb-pc)\times Ct \qquad \text{Formula (3)}$$

C16C: Correction Coefficient Storage Unit

The correction coefficient storage unit C16C stores a correction coefficient which is used in the correction of the remaining 10% determination value tb. The correction coefficient Ch in accordance with Example 1 is set to a numerical value which is greater than 0 and is less than 1, and is set to Ch=0.5 in Example 1. Namely, if the correction value tf is applied as it is in the case of correcting the remaining 10% determination value tb, the correction value tf is undesirably overcorrected owing to variations, so that there is a possibility that the fluctuation of the value of the remaining 10% determination value tb becomes large on each occasion of the correction. However, by using the correction coefficient Ch, an overcorrection based on the correction value tf can be reduced, making it possible to make the fluctuation of the value of the remaining 10% determination value tb small.

C16D: Changeover Value Computing Unit

The changeover value computing unit C16D performs computation of the remaining 10% determination value tb on the basis of the correction value tf and the correction coefficient Ch. In the case where the copier U is connected to the management server COM1, the changeover value computing unit C16D in accordance with Example 1 computes the remaining 10% determination value tb on the basis of the correction value tf received by the changeover value receiving unit C13A. On the other hand, in the case where the copier U is not connected to the management server COM1, the changeover value computing unit C16D computes the remaining 10% determination value tb on the basis of the correction value tf computed by the correction value computing unit C16B. The changeover value computing unit C16D in accordance with Example 1 computes the remaining 10% determination value tb from the following Formula (4).

$$tb=tb+tf\times Ch \quad \text{Formula (4)}$$

C16E: Emptiness Determination Value Computing Unit

The emptiness determination value computing unit C16E as an example of a replacement time computing unit performs computation of the emptiness determination time tc as an example of replacement time information on the basis of the correction value tf. In the case where the copier U is connected to the management server COM1, the emptiness determination value computing unit C16E in accordance with Example 1 computes the emptiness determination time tc from the remaining 10% determination value tb derived from the correction value tf, on the basis of the correction value tf received by the changeover value receiving unit C13A and from a calculation coefficient Cδ for computing the emptiness determination time tc from the remaining 10% determination value tb. On the other hand, in the case where the copier U is not connected to the management server COM1, the emptiness determination value computing unit C16E computes the emptiness determination time tc from the remaining 10% determination value tb derived on the basis of the correction value tf computed by the correction value computing unit C16B and from the aforementioned calculation coefficient Cδ. Namely, the emptiness determination value computing unit C16E in accordance with Example 1 computes the emptiness determination time tc from the following Formula (5) by using the calculation coefficient Cδ for computing the emptiness determination time tc corresponding to a toner consumption amount of 100% with respect to the remaining 10% determination value tb corresponding to a toner consumption amount of 90%.

$$tc=tb\times C\delta \quad \text{Formula (5)}$$

C17: Prediction Lifetime Updating Unit

A prediction lifetime updating unit C17 has a remaining amount updating unit C17A, a changeover value updating unit C17B, and an emptiness determination value updating unit C17C, and performs updating of information concerning the prediction lifetime of each of the toner cartridges Ky to Kk. In the case where the copier U is connected to the management server COM1, the prediction lifetime updating unit C17 in accordance with Example 1 updates the prediction lifetime of each of the toner cartridges Ky to Kk on the basis of the managed lifetime information, whereas in the case where it is not connected to the management server COM1, the prediction lifetime updating unit C17 updates the prediction lifetime of each of the toner cartridges Ky to Kk on the basis of the prediction lifetime Z learned by the learning unit C16.

C17A: Remaining Amount Updating Unit

The remaining amount updating unit C17 updates the remaining amount Z stored in the prediction lifetime storage unit C14. In the case where the copier U is connected to the management server COM1, the remaining amount updating unit C17 in accordance with Example 1 updates the predicted remaining amount Z as an example of a prediction lifetime stored in the prediction lifetime storage unit C14, on the basis of the managed lifetime information received by the managed lifetime information receiving unit C13. On the other hand, in the case where the copier U is not connected to the management server COM1, the remaining amount updating unit C17 updates the predicted remaining amount Z as an example of a prediction lifetime stored in the prediction lifetime storage unit C14, on the basis of the predicted prediction lifetimes Z1 and Z2 predicted by the main body predicting unit C10.

C17B: Changeover Value Updating Unit

The changeover value updating unit C17B updates the remaining 10% determination value tb as an example of a changeover value stored in the changeover value storage unit C10A to the remaining 10% determination value tb computed by the changeover value computing unit C16D. Accordingly, in the case where the copier U is connected to the management server COM1, the changeover value updating unit C17B in accordance with Example 1 updates the remaining 10% determination value tb stored in the changeover value storage unit C10A to the remaining 10% determination value tb computed on the basis of the correction value tf included the managed lifetime information received by the changeover value receiving unit C13A. On the other hand, in the case where the copier U is not connected to the management server COM1, the changeover value updating unit C17B updates the remaining 10% determination value tb to the remaining 10% determination value tb derived from the correction value tf computed and learned by the correction value computing unit C16B on the basis of the cumulative pixel value pb.

C17C: Emptiness Determination Value Updating Unit

The emptiness determination value updating unit C17C updates the emptiness determination time tc corresponding to the cumulative replenishment time to at the time when each of the toner cartridges Ky to Kk is predicted to become empty. The emptiness determination value updating unit C17C in accordance with Example 1 updates the emptiness determination time tc to the emptiness determination time tc computed by the emptiness determination computing unit C16E. Accordingly, in the case where the copier U is connected to the management server COM1, the emptiness determination value updating unit C17C in accordance with Example 1 updates the emptiness determination time tc to the emptiness determination time tc computed on the basis of the correction value tf included in the managed lifetime information received by the changeover value receiving unit C13A. On the other hand, in the case where the copier U is not connected to the management server COM1, the emptiness determination value updating unit C17C updates the emptiness determination time tc to the emptiness determination time tc derived from the correction value tf computed and learned by the correction value computing unit C16B on the basis of the cumulative pixel value pb.

C18: Replacement Detecting Unit

A replacement detecting unit C18 determines whether or not the toner cartridges Ky to Kk have been replaced. When it is detected on the basis of the detection result of the emptiness detection sensor SN0 that the toners have flowed from the toner cartridges Ky to Kk, which were determined to have become empty, into the toner dispenser device U3*b*, the replacement detecting unit C18 in accordance with Example 1 determines that the toner cartridges Ky to Kk have been replaced. It should be noted that the replacement detecting unit C18 in accordance with Example 1 also determines unused states of the toner cartridges Ky to Kk, i.e., whether they are so-called new products, whether they are being in use, and whether they are empty, on the basis of the information stored in the storage media, i.e., so-called memories, that are mounted on the toner cartridges Ky to Kk. It should be noted that, in addition to the information for determining whether the toner cartridges are unused, being in use, or empty, information concerning the state of use of the toner cartridges Ky to Kk, such as the predicted remaining amount Z, the cumulative replenishment time ta, the total pixel value pa, the cumulative pixel value pb, and the transmission determination value td, is stored in the memories of the toner cartridges Ky to Kk, and is updated during the use of the copier U each time the information is updated.

(Description of the Control Unit of the Management Server)

Figure 6:
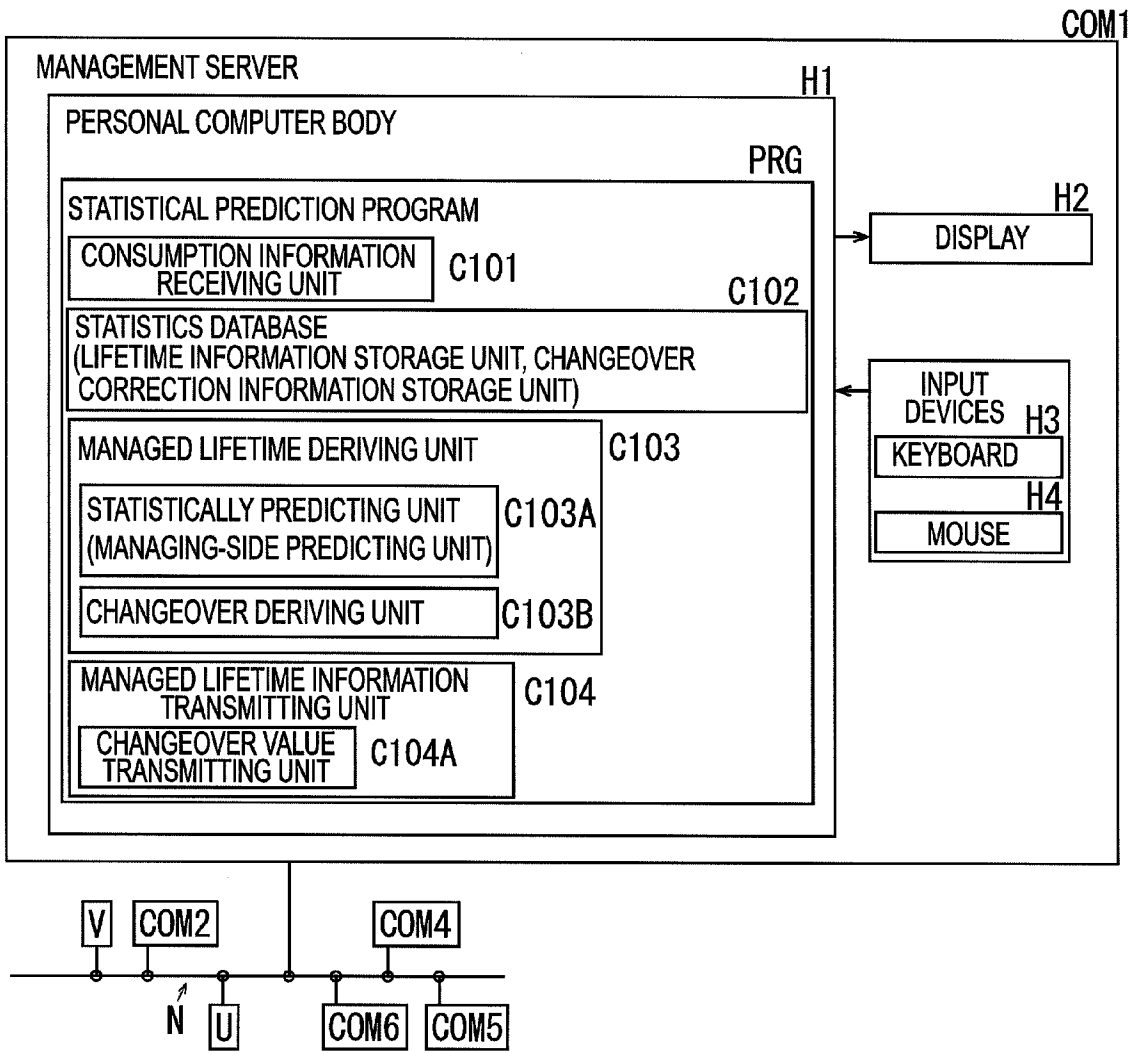
FIG. 6 is a block diagram illustrating the functions of a controlling section of a managing apparatus in accordance with Example 1 of the invention.

FIG. 6 is a block diagram illustrating the functions of a controlling section of the managing apparatus in accordance with Example 1 of the invention.

In FIG. 6, the management server COM1 of Example 1 is constituted by an information processor, i.e., a so-called computer apparatus, and includes, among others, I/O devices for effecting the inputting and outputting of signals with respect to an external circuit and for effecting such as adjustment of an input/output signal level; a ROM in which a program for executing necessary processing, data, and the like are stored; a RAM and a HDD for temporarily storing necessary data; and a CPU for performing processing corresponding to the programs stored in the ROM and the HDD. The management server COM1 is able to realize various functions by executing the program stored in the ROM.

(Signal Input Elements Connected to the Apparatus Body H1)

Output signals from signal output elements such as the keyboard H3 and the mouse H4 are inputted to the apparatus body H1 of the management server COM1.

(Controlled Elements Connected to the Apparatus Body H1)

The apparatus body H1 outputs control signals for the display H2 to display images on the display H2.

(Functions of the Apparatus Body H1)

A statistical prediction program PRG of the apparatus body H1 has the functions of outputting control signals to the respective controlled elements by executing processing corresponding to input signals from the aforementioned signal output elements. Namely, the statistical prediction program PRG has the following functions.

C101: Consumption Information Receiving Unit

A consumption information receiving unit C101 receives and stores consumption information transmitted from the copier U connected to the management server COM1.

C102: Statistics Database

A statistics database C102, which is an example of a lifetime information storage unit and an example of a changeover correction information storage unit, stores managed lifetime information for deriving the lifetime of the toner cartridges Ky to Kk from the consumption information on the basis of the consumption information transmitted thereto from plural image forming apparatuses U and V connected through the network N and the consumption information at the time when the service lives of the toner cartridges Ky to Kk are determined to have expired, i.e., to have become empty. The statistics database C102 in accordance with Example 1 stores as one item of managed lifetime information the correction value tf as an example of changeover correction information for correcting the remaining 10% determination value tb from the consumption information on the basis of the consumption information transmitted thereto from plural image forming apparatuses U and V connected through the network N and the consumption information at the time when the service lives of the toner cartridges Ky to Kk are determined to have become empty. Also, the statistics database C102 in accordance with Example 1 stores as another item of the managed lifetime information the prediction lifetime information for deriving the predicted remaining amount Z from the consumption information on the basis of the consumption information on the plural image forming apparatuses U and V and the consumption information at the time when the service lives of the toner cartridges Ky to Kk are determined to have become empty. Namely, the statistics database C102 in accordance with Example 1 stores statistical data on correction values tf and predicted remaining amounts Z with respect to the consumption information including the cumulative replenishment time ta, the total pixel value pa, the cumulative number of prints, the average image density of formed images, the average number of continuous prints, the monochromatic print/multi-color print ratio, the frequency of the size of the medium used, the working environment such as the temperature and humidity, the district of use, and the like.

C103: Managed Lifetime Deriving Unit

A managed lifetime deriving unit C103 as an example of a lifetime deriving unit has a statistically predicting unit C103A and a changeover deriving unit C103B, and derives information on the lifetime of the toner cartridges Ky to Kk of the image forming apparatuses U and V which transmitted the consumption information, on the basis of the consumption information received by the consumption information receiving unit C101 and a predetermined managed lifetime information stored in the statistics database C102.

C103A: Statistically Predicting Unit

The statistically predicting unit C103A as a managing-side predicting unit predicts the prediction lifetime, i.e., derives the predicted remaining amount Z, of the toner cartridges Ky to Kk of the image forming apparatuses U and V which transmitted the consumption information, on the basis of the consumption information received thereby and the prediction lifetime information stored in the statistics database C102. It should be noted that since methods for statistically deriving the predicted remaining amount Z of each of the toner cartridges Ky to Kk are conventionally known from the techniques described in, for example, Patent Documents 1 and 4, it is possible to adopt various methods, so that a detailed description thereof will be omitted.

C103B: Changeover Deriving Unit

The changeover deriving unit C103B as an example of a determination value deriving unit derives the remaining 10% determination value tb and the emptiness determination time tc of the image forming apparatuses U and V which transmitted the consumption information, on the basis of the consumption information received thereby and the information on the correction values tf stored in the statistics data base C102. The changeover deriving unit C103B in accordance with Example 1 does not directly derive the remaining 10% determination value tb and the emptiness determination time tc, but statistically acquires the correction value tf which is indirectly required for deriving the remaining 10% determination value tb and the emptiness determination time tc. It should be noted that the method for statistically deriving the correction value tf can be effected in the same way as the statistically predicting unit C103A, so that a detailed description thereof will be omitted. It should be noted that, in the statistics database C102 in accordance with Example 1, the information on the correction values tf and the remaining amounts Z stored is learned and updated on the basis of the consumption information received and the correction values tf derived, and is utilized in the prediction of the remaining amounts Z and the derivation of the correction values tf on the next and subsequent occasions.

C104: Managed Lifetime Information Transmitting Unit

A managed lifetime information transmitting unit C104 has a changeover value transmitting unit C104A, which transmits the information on the predicted remaining amount Z predicted by the statistically predicting unit C103A to the image forming apparatuses U and V that transmitted the consumption information, as the managed lifetime information which is the prediction lifetime information predicted by the management server COM1.

C104A: Changeover Value Transmitting Unit

The changeover value transmitting unit C104A transmits the correction value tf derived by the changeover deriving unit C103B to the image forming apparatuses U and V which transmitted the consumption information, as management changeover value information which is information on the changeover value computed by the management server COM1.

Description of the Flowchart of Example 1

Next, a description will be given of the flow of processing by the image forming apparatus U in accordance with Example 1 with reference to a flowchart.

(Description of the Flowchart of System Connection Determination Processing)

Figure 7:
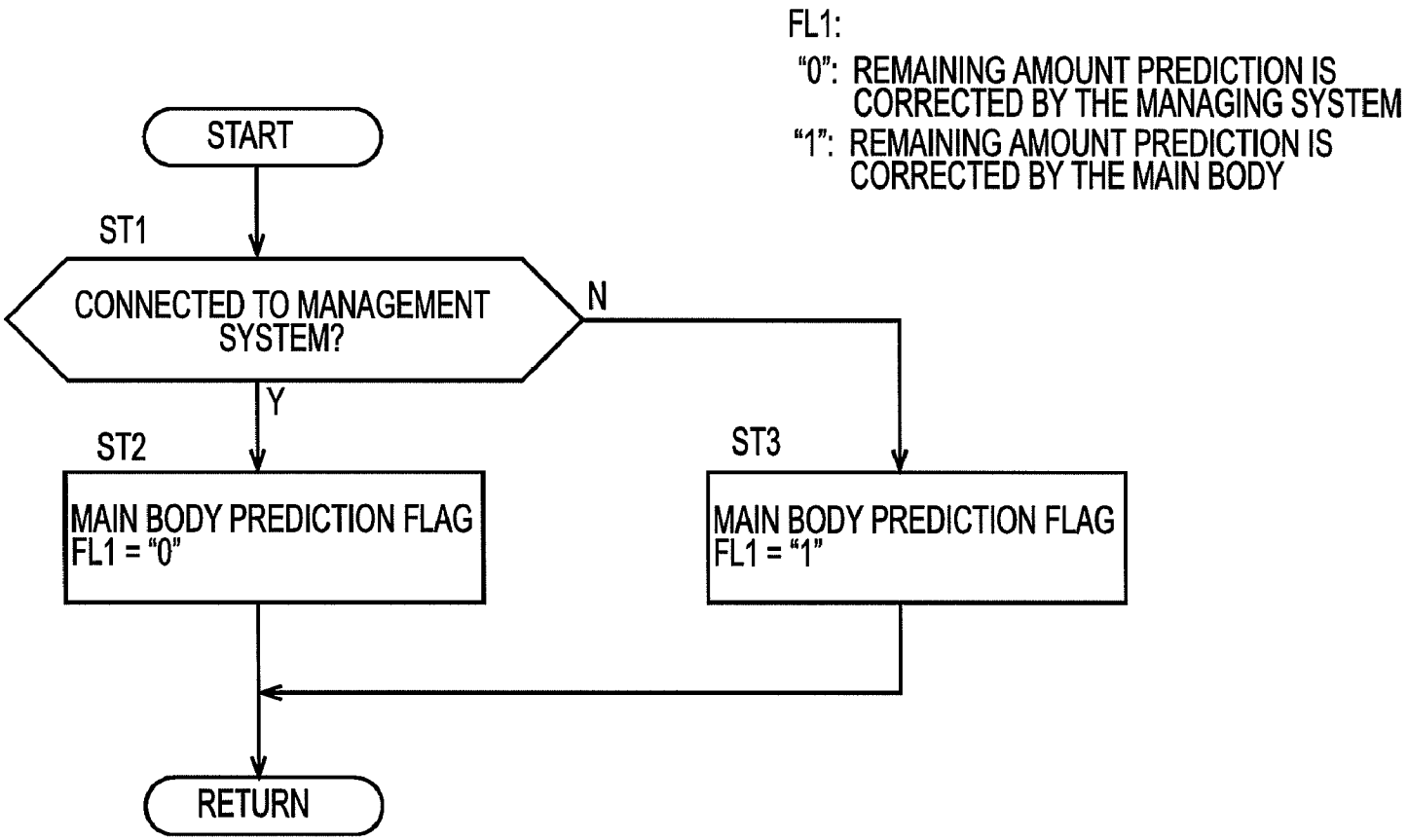
FIG. 7 is a flowchart of system connection determination processing in accordance with Example 1.

FIG. 7 is a flowchart of system connection determination processing in accordance with Example 1.

The processing of each ST (step) in the flowchart of FIG. 7 is performed in accordance with the program stored in the hard disk or the like of the controller C of the copier U. In addition, this processing is executed by parallel processing in parallel with various other processing by the copier U.

The flowchart shown in FIG. 7 is started when the power of the copier U is turned on.

In ST 1 in FIG. 7, a determination is made as to whether or not the copier U is connected to the management system SYS. In the case of YES (Y), the operation proceeds to ST2, and in the case of NO (N), the operation proceeds to ST3.

In ST2, the main body prediction flag FL1 is set to "0". and the operation returns to ST1.

In ST3, the main body prediction flag FL1 is set to "1". and the operation returns to ST1.

(Description of the Flowchart of Developer Remaining Amount Prediction Processing)

Figure 8:
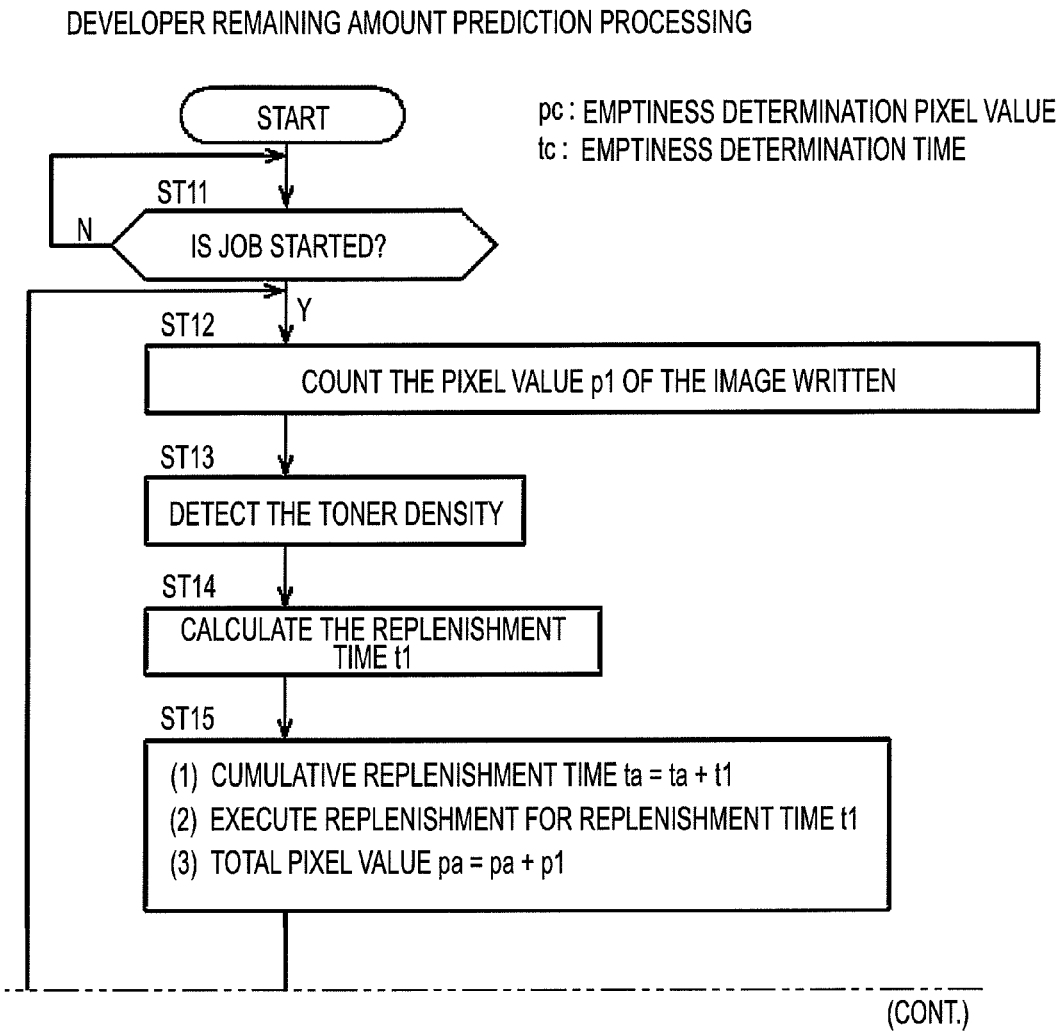
FIG. 8 is a flowchart of developer remaining amount prediction processing in accordance with Example 1.

FIG. 8 is a flowchart of developer remaining amount prediction processing in accordance with Example 1.

The processing of each ST (step) in the flowchart of FIG. 8 is performed in accordance with the program stored in the hard disk or the like of the controller C of the copier U. In addition, this processing is executed by parallel processing in parallel with various other processing by the copier U. It should be noted that, in the following processing, similar processing is executed for each color of Y, M, C, and K, so that a description will be given of only the Y color, and illustration and description of the other colors will be omitted.

The flowchart shown in FIG. 8 is started when the power of the copier U is turned on.

In ST11 in FIG. 8, a determination is made as to whether or not a job, which is an image formation operation, has been started. In the case of YES (Y), the operation proceeds to ST12, and in the case of NO (N), ST11 is repeated.

In ST12, the pixel value p1 of a latent image which is written by the latent image forming device ROSy of counted. The operation then proceeds to ST13.

In ST13, the toner density of the developing device Gy is detected on the basis of a detection signal from the toner density sensor SN1. The operation then proceeds to ST14.

In ST14, the toner replenishment time t1 is calculated on the basis of the pixel value p1 and the detected toner density. The operation then proceeds to ST15.

In ST15, the following processing (1) to (3) is executed, and the operation proceeds to ST16.

(1) The replenishment time t1 is added to the cumulative replenishment time ta, i.e., ta=ta+t1.

(2) Replenishment is executed for a toner replenishment time t1.

(3) The pixel value p1 is added to the total pixel value pa, i.e., pa=pa+p1.

In ST16, a determination is made as to whether or not the main body prediction flag FL1 is "1". In the case of YES (Y), the operation proceeds to ST17, and in the case of NO (N), the operation proceeds to ST25.

In ST17, a determination is made as to whether or not the cumulative replenishment time ta is equal to or greater than the remaining 10% determination value tb. In the case of YES (Y), the operation proceeds to ST18, and in the case of NO (N), the operation proceeds to ST20.

In ST18, in the case where the remaining amount is 10% or less, the pixel value p1 is added to the cumulative pixel value pb, i.e., pb=pb+t1. The operation then proceeds to ST19.

In ST19, the toner remaining amount Z is computed on the basis of the cumulative pixel value pb in the case where the remaining amount is 10% or less, i.e., computation is made of $Z=Z2=(0.1-pb/pc)\times 100$. The operation then proceeds to ST21.

In ST20, the toner remaining amount Z is computed on the basis of the cumulative replenishment time ta, i.e., computation is made of $Z=Z1=(1-ta/tc)\times 100$. The operation then proceeds to ST21.

In ST21, a determination is made as to whether or not the toner remaining amounts Z1 and Z2 are equal to or greater than 0. In the case of NO (N), the operation proceeds to ST22, and in the case of YES (Y), the operation proceeds to ST23.

In ST22, since the toner remaining amounts Z1 and Z2 are minus values, Z1 and Z2 are set to "0". The operation then proceeds to ST23.

In ST23, the toner remaining amount Z1 or Z2 is displayed on the display unit UI. The operation then proceeds to ST24.

In ST24, a determination is made as to whether or not the job ended. In the case of NO (N), the operation returns to ST12, and in the case of YES (Y), the operation returns to ST11.

In ST25, a determination is made as to whether or not the cumulative replenishment time ta is equal to or greater than the transmission determination value td. In the case of YES (Y), the operation returns to ST26, and in the case of NO (N), the operation returns to ST24.

In ST26, remaining amount determination information is transmitted to the management server COM1. The operation then proceeds to ST27.

In ST27, the transmission interval te is added to the transmission determination value td, i.e., td=td+te. The operation then proceeds to ST24.

(Description of the Flowchart of Changeover Value Learning Processing)

Figure 9:
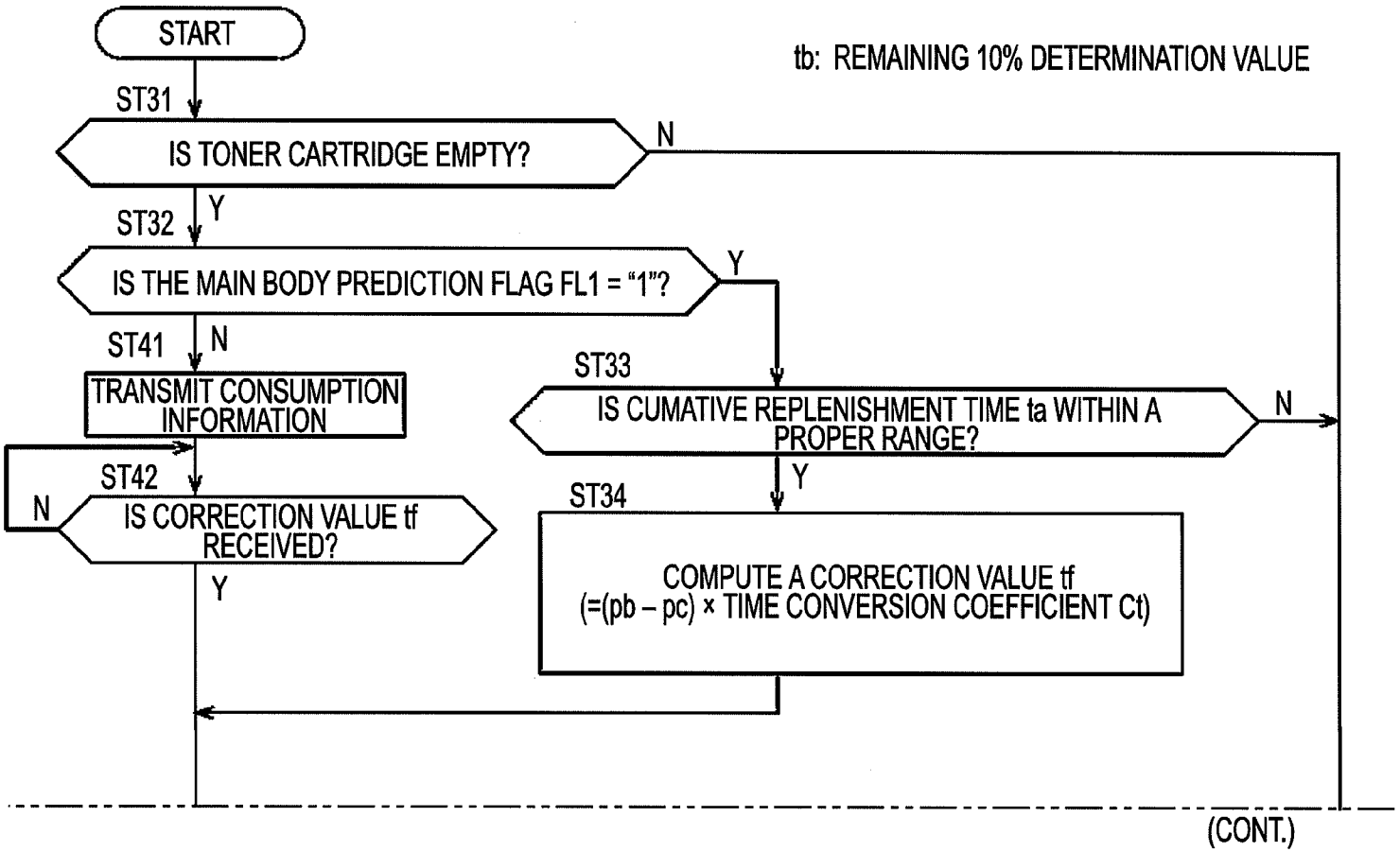
FIG. 9 is a flowchart of changeover value learning processing in accordance with Example 1.

FIG. 9 is a flowchart of changeover value learning processing in accordance with Example 1.

The processing of each ST (step) in the flowchart of FIG. 9 is performed in accordance with the program stored in the hard disk or the like of the controller C of the copier U. In addition, this processing is executed by parallel processing in parallel with various other processing by the copier U. It should be noted that, in the following processing, similar processing is executed for each color of Y, M, C, and K, so that a description will be given of only the Y color, and illustration and description of the other colors will be omitted.

The flowchart shown in FIG. 9 is started when the power of the copier U is turned on.

In ST31 in FIG. 9, a determination is made as to whether or not the toner cartridge Ky has become empty. In the case of YES (Y), the operation proceeds to ST32, and in the case of NO (N), ST31 is repeated.

In ST32, a determination is made as to whether or not the main body prediction flag FL1 is "1". In the case of YES (Y), the operation proceeds to ST33, and in the case of NO (N), the operation proceeds to ST41.

In ST33, a determination is made as to whether or not the cumulative replenishment time to is within the proper range A. In the case of YES (Y), the operation proceeds to ST34, and in the case of NO (N), the operation returns to ST31.

In ST34, the correction time $tf=(pb-pc)\times Ct$ is computed in accordance with Formula (3). The operation then proceeds to ST35.

In ST35, the remaining 10% determination value $tb=tb+tf\times Ch$ is computed in accordance with Formula (4). The operation then proceeds to ST36.

In ST36, a determination is made as to whether or not the remaining 10% determination value tb is equal to or greater than an upper limit tb1 of a remaining 10% determination value tb set in advance. In the case of YES (Y), the operation proceeds to ST37, and in the case of NO (N), the operation proceeds to ST38.

In ST37, the remaining 10% determination value tb is set to the upper limit tb1, and the operation proceeds to Step 40.

In ST38, a determination is made as to whether or not the remaining 10% determination value tb is equal to or less than a lower limit tb2 of the remaining 10% determination value tb set in advance. In the case of YES (Y), the operation proceeds to ST39, and in the case of NO (N), the operation proceeds to ST40.

In ST39, the remaining 10% determination value tb is set to the lower limit tb2, and the operation proceeds to Step 40.

In ST40, the emptiness determination time $tc=tb\times C\delta$ is computed in accordance with Formula (5), and is updated. The operation then returns to ST31.

In ST41, consumption information is transmitted to the connected management server COM1. The operation then proceeds to Step 42.

In ST42, a determination is made as to whether or not the correction value tf transmitted from the management server COM1 in response to the consumption information has been received. In the case of YES (Y), the operation proceeds to ST35, and in the case of NO (N), ST42 is repeated.

(Description of the Flowchart of Replacement Detection Processing)

Figure 10:
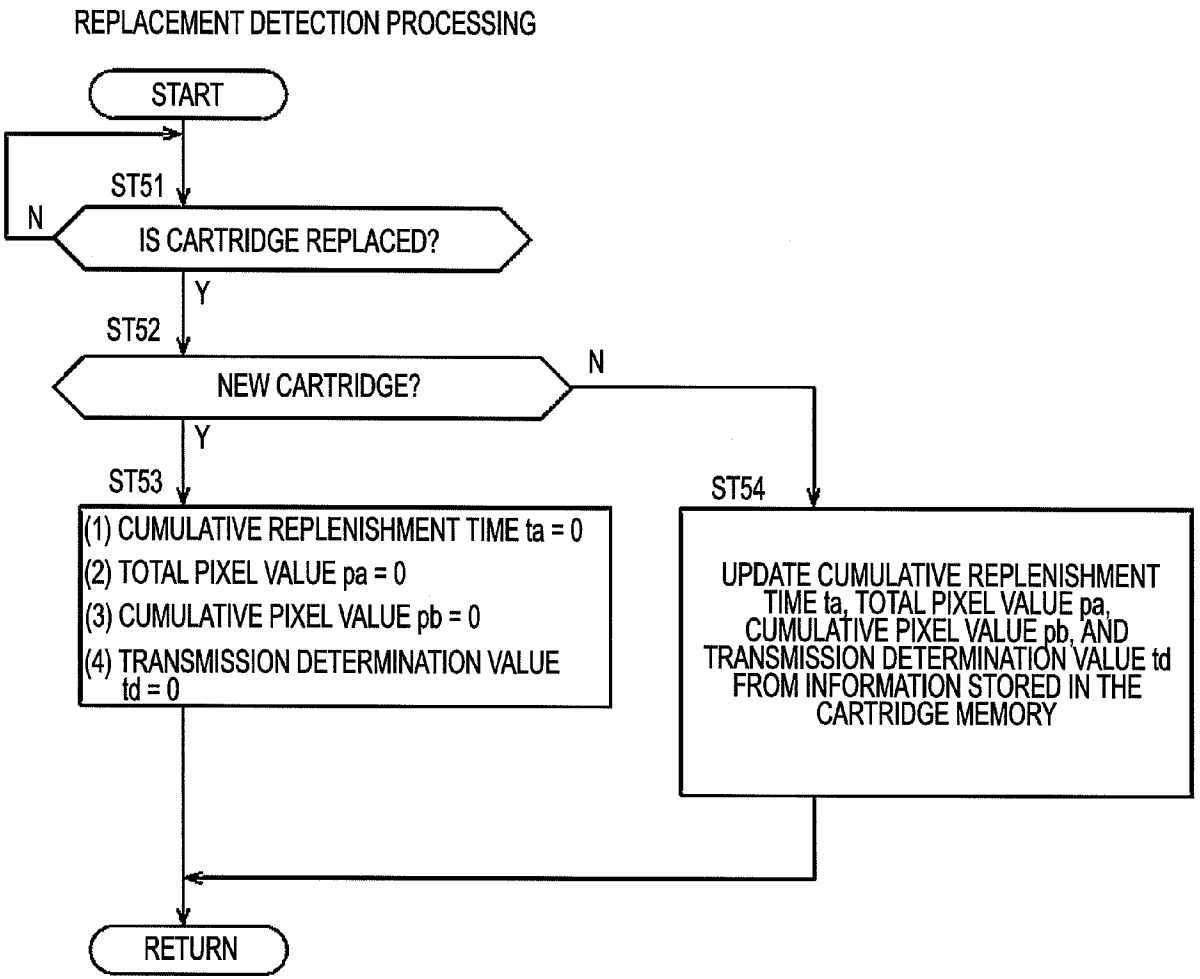
FIG. 10 is a flowchart of replacement detection processing in accordance with Example 1.

FIG. 10 is a flowchart of replacement detection processing in accordance with Example 1.

The processing of each ST (step) in the flowchart of FIG. 10 is performed in accordance with the program stored in the hard disk or the like of the controller C of the copier U. In addition, this processing is executed by parallel processing in parallel with various other processing by the copier U. It should be noted that, in the following processing, similar processing is executed for each color of Y, M, C, and K, so that a description will be given of only the Y color, and illustration and description of the other colors will be omitted.

The flowchart shown in FIG. 10 is started when the power of the copier U is turned on.

In ST31 in FIG. 10, a determination is made as to whether or not the toner cartridge Ky has been replaced. In the case of YES (Y), the operation proceeds to ST52, and in the case of NO (N), ST51 is repeated.

In ST52, a determination is made as to whether or not the replaced toner cartridge Ky is an unused toner cartridge Ky, i.e., a new toner cartridge Ky, on the basis of the information stored in the recording medium, i.e., the memory, of the toner cartridge Ky. In the case of YES (Y), the operation proceeds to ST53, and in the case of NO (N), the operation proceeds to ST54.

In ST53, the following processing (1) to (4) is executed, and the operation returns to ST51.

(1) The cumulative replenishment time ta is initialized to 0, i.e., ta=0.

(2) The total pixel value pa is initialized to 0, i.e., pa=0.

(3) The cumulative pixel value pb is initialized to 0, i.e., pb=0.

(4) The transmission determination value td is initialized to 0, i.e., td=0.

In ST 54, the cumulative replenishment time ta, the total pixel value pa, the cumulative pixel value pb, and the transmission determination value td are updated on the basis of the information stored in the memory of the replaced toner cartridge Ky. The operation then returns to ST51.

(Description of the Flowchart of Statistical Remaining Amount Prediction Processing)

Figure 11:
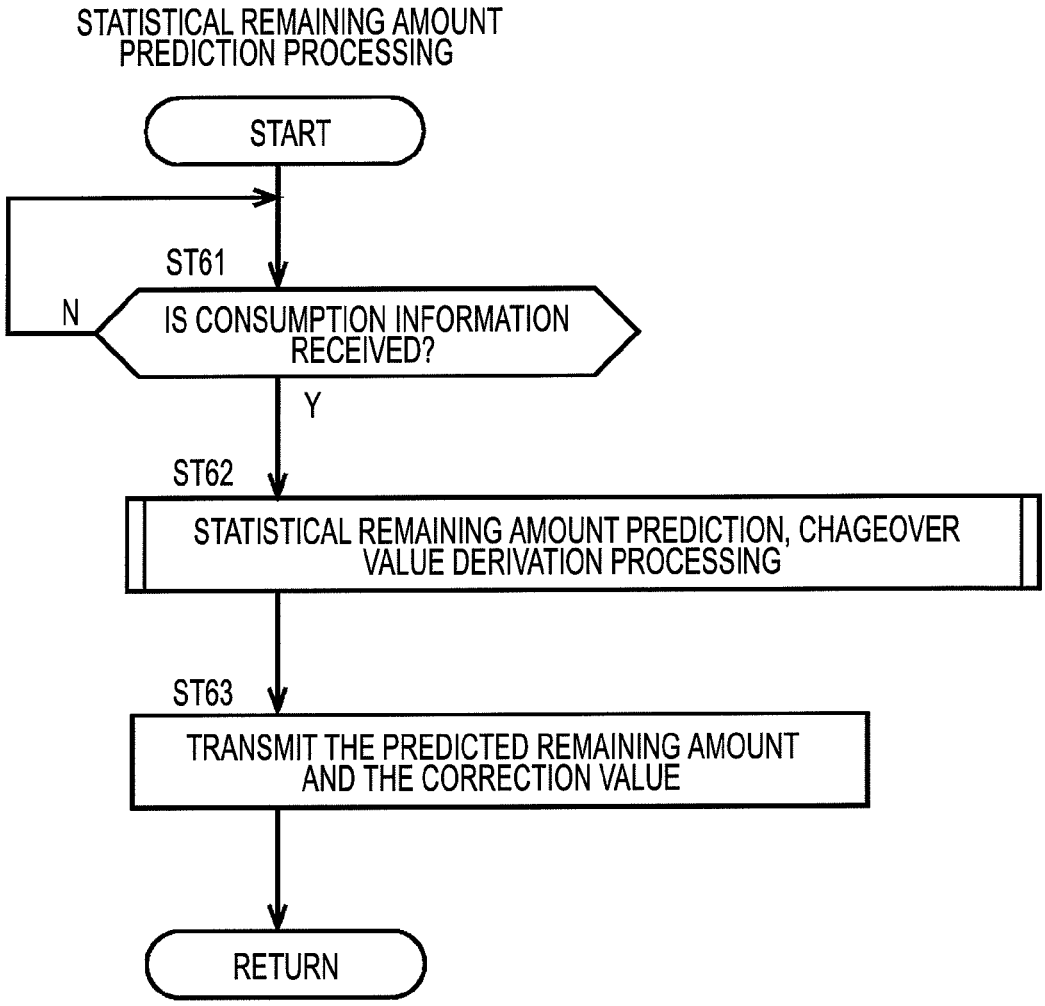
FIG. 11 is a flowchart of statistical remaining amount prediction processing in accordance with Example 1.

FIG. 11 is a flowchart of statistical remaining amount prediction processing in accordance with Example 1.

The processing of each ST (step) in the flowchart of FIG. 11 is performed in accordance with the statistical prediction program PRG stored in the hard disk or the like of the apparatus body H1 of the management server COM1. In addition, this processing is executed by parallel processing in parallel with various other processing by the management server COM1

The flowchart shown in FIG. 11 is started when the statistical prediction program PRG is started.

In ST61 in FIG. 11, a determination is made as to whether or not consumption information transmitted from the image forming apparatuses U and V has been received. In the case of YES (Y), the operation proceeds to ST62, and in the case of NO (N), ST61 is repeated.

In ST62, statistical remaining amount prediction processing and changeover value deriving processing are executed, and a statistical predicted remaining amount Z and correction value tf are calculated. The operation then proceeds to ST63.

In ST63, the predicted remaining amount Z and the correction value tf thus obtained are transmitted to the image forming apparatuses U and V which transmitted the consumption information. The operation then returns to ST61.

(Description of the Flowchart of Predicted Remaining Amount Display Processing)

Figure 12:
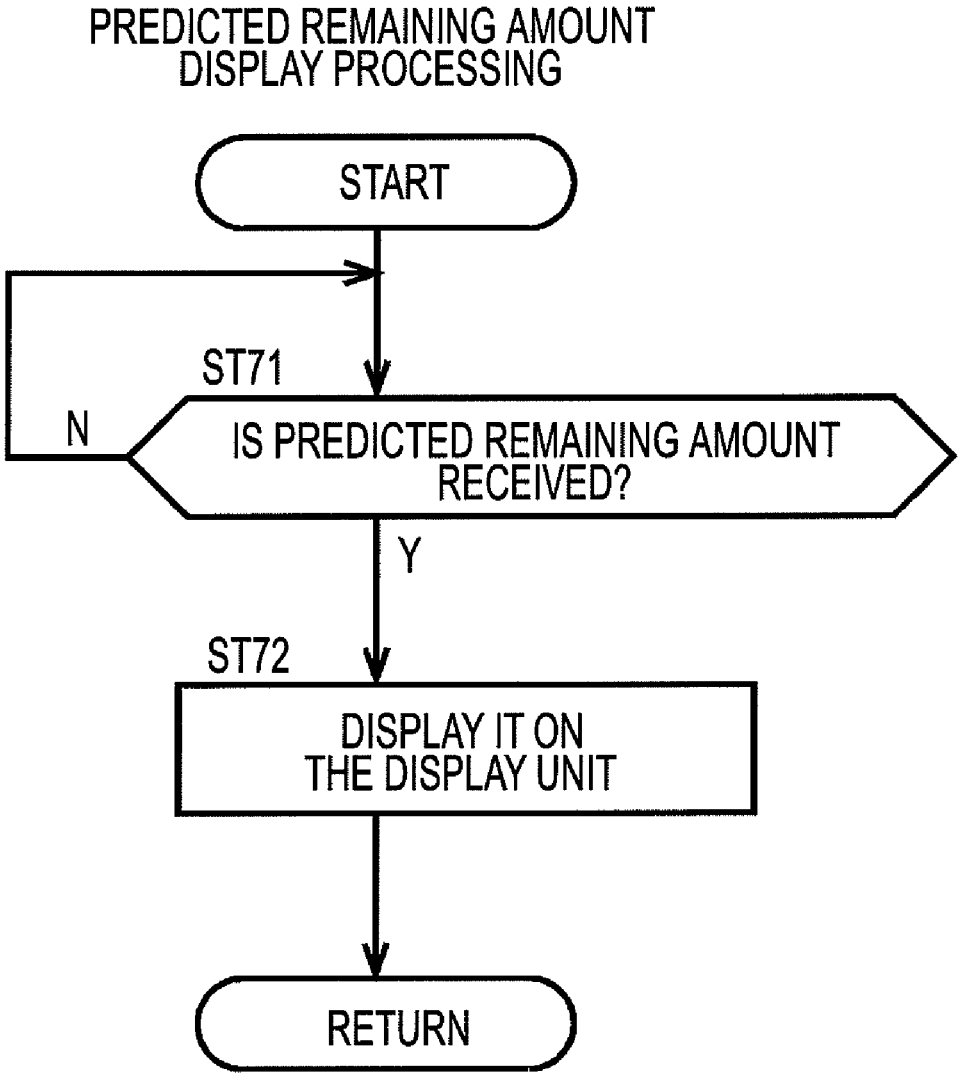
FIG. 12 is a flowchart of predicted remaining amount display processing in accordance with Example 1.

FIG. 12 is a flowchart of predicted remaining amount display processing in accordance with Example 1.

The processing of each ST (step) in the flowchart of FIG. 12 is performed in accordance with the program stored in the hard disk or the like of the controller C of the copier U. In addition, this processing is executed by parallel processing in parallel with various other processing by the copier U. It should be noted that, in the following processing, similar processing is executed for each color of Y, M, C, and K, so that a description will be given of only the Y color, and illustration and description of the other colors will be omitted.

The flowchart shown in FIG. 12 is started when the power of the copier U is turned on.

In ST71 in FIG. 12, a determination is made as to whether or not the predicted remaining amount Z transmitted from the management server COM1 has been received. In the case of YES (Y), the operation proceeds to ST72, and in the case of NO (N), ST71 is repeated.

In ST72, the received predicted remaining amount Z is displayed on the display unit UI3. The operation then returns to ST71.

Operation of Example 1

In the copier U in accordance with Example 1 having the above-described configuration, in the state in which the copier U is connected to the network N, and transmission and reception of information with respect to the management server COM1 is possible, the remaining amounts Z of the toner cartridges Ky to Kk of the copier U are predicted and updated by the management server COM1 on the basis of statistical information. Then, when the toner cartridges Ky to Kk become empty, individual differences can be ascertained for the copier U due to such factors as differences in lots of the replenishment motors M2 of the copier U and the variation in the assembly thereof and differences in lots of the toners. If the predicted remaining amount Z deviates in light of a difference with statistical information, the correction value tf is derived, and the remaining 10% determination value tb and the emptiness determination time tc of the copier U are corrected.

In cases where the copier U is not connected to the network N or is disconnected from the network N, or the management server COM1 has not been started, the remaining amounts Z of the toner cartridges Ky to Kk of the copier U are predicted by the main body predicting unit C10. Then, when the toner cartridges Ky to Kk become empty, in the case where the predicted remaining amount Z deviates in light of the individual differences of the copier U, the remaining 10% determination value tb and the emptiness determination time Tc which were used, the correction value tf is derived, and the remaining 10% determination value tb and the emptiness determination time tc of the copier U are learned and updated.

Accordingly, in the copier U in accordance with Example 1, depending on whether or not it is connected to the management server COM1, the prediction of the remaining amount Z is executed by the management server COM1 which is capable of statistically predicting with high accuracy from the plural items of consumption information from the plural image forming apparatuses or by the copier U which is capable of directly deriving remaining amounts Z catering to individual differences. Accordingly, the prediction of the remaining amount corresponding to the condition of the copier U is made possible, and the accuracy in the prediction of the remaining amount is improved.

In addition, depending on whether or not the copier U is connected to the management server COM1, the correction value tf is derived by the management server COM1 which is capable of statistically predicting with high accuracy from the plural items of consumption information from the plurality of image forming apparatuses or by the copier U which is capable of directly deriving correction values tf catering to individual differences, and the learning of the remaining 10% determination value tb and the emptiness determination time tc is carried out. Hence, the remaining 10% determination value tb and the emptiness determination time tc are updated, as required, to optimum values in corresponded with the state of connection, so that the accuracy of prediction of the remaining amount Z using the remaining 10% determination value tb and the emptiness determination time tc is improved.

In addition, in the case where the copier U is connected to the management server COM1, the predicted remaining amount Z and the correction value tf transmitted from the management server COM1 are used, and the predicted remaining amount Z and the correction value tf are not computed by the copier U. Accordingly, the prediction of the remaining amount and the correction using the correction value tf are avoided from being carried out doubly.

Furthermore, in Example 1, the correction coefficient Ch is used, so that an overcorrection at the time of correction due to variation is suppressed, thereby improving the accuracy in the prediction of the remaining 10% determination value tb and the emptiness determination time tc.

In addition, in Example 1, the prediction of the remaining amount is effected by the cumulative replenishment time ta until the predicted remaining amounts Z of the toner cartridges Ky to Kk reach the remaining 10%, and the prediction of the remaining amount is effected by using the cumulative pixel value pb from the remaining 10% onward. Accordingly, the prediction is carried out by using the cumulative replenishment time ta during which there is a sufficient amount of toner and the replenishment rate is stable, and which tends to be higher in accuracy than the cumulative pixel value pb. Meanwhile, when a state is reached in which the amount of toner has become small and the replenishment rate is hence likely to be unstable, the prediction is carried out by using the cumulative pixel value pb. Thus, the accuracy in the prediction of the remaining amount Z is improved as compared with cases where only the cumulative replenishment time ta or the cumulative pixel value pb is used.

EXAMPLE 2

Next, a description will be given of Example 2 in accordance with the invention. In the description of this Example 2, those component elements that correspond to those of the foregoing Example 1 will be denoted by identical reference numerals, and a detailed description thereof will be omitted.

This Example 2 differs from the foregoing Example 1 in the following aspects, but is configured in the same way as Example 1 in the other aspects.

Description of the Control Unit of Example 2

Figure 13:
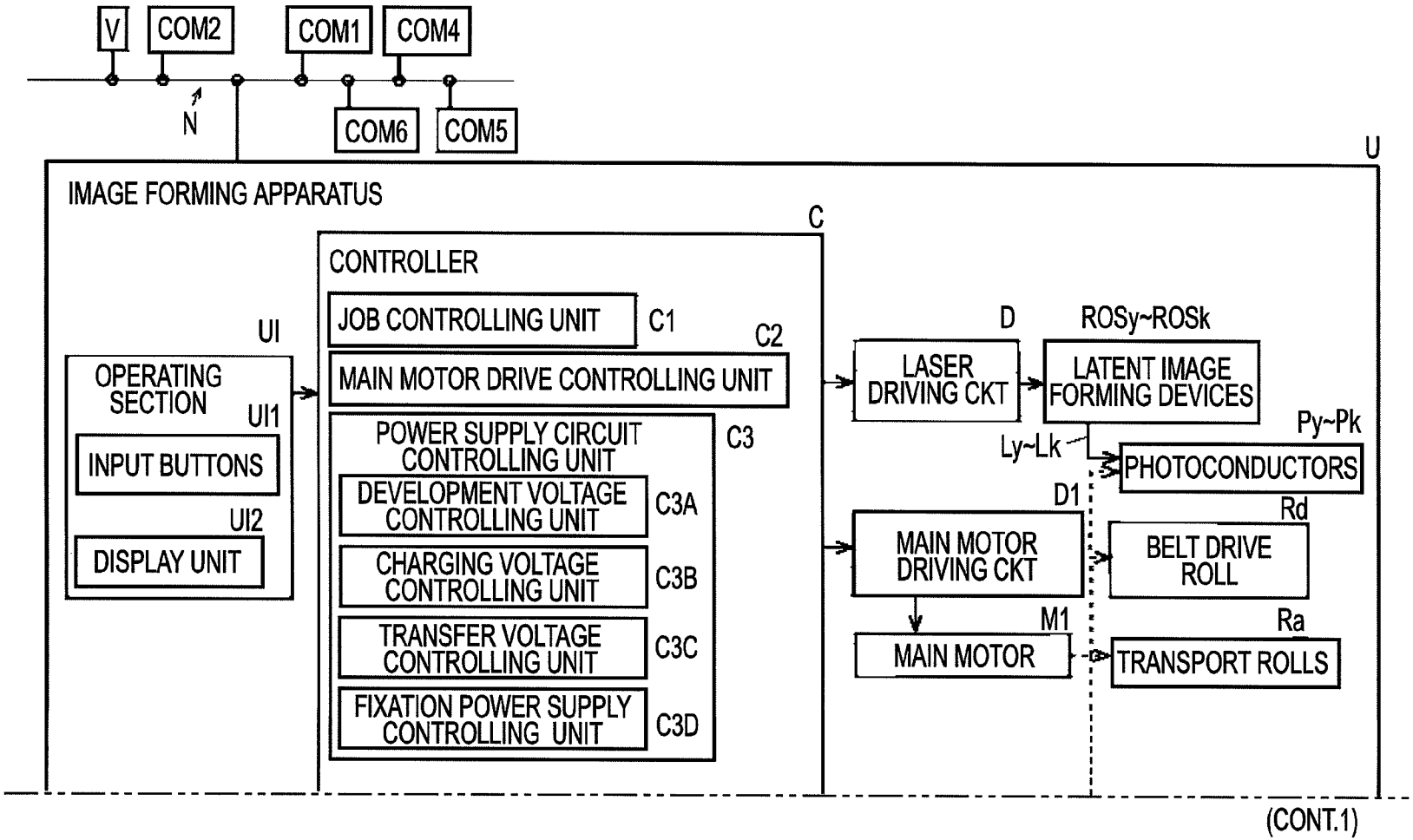
FIG. 13 is a block diagram illustrating the functions of a controlling section of the image forming apparatus in accordance with Example 2 of the invention, and is a diagram corresponding to FIG. 3 in accordance with Example 1.

FIG. 13 is a block diagram illustrating the functions of a controlling section of the image forming apparatus in accordance with Example 2 of the invention, and is a diagram corresponding to FIG. 3 in accordance with Example 1.

Figure 14:
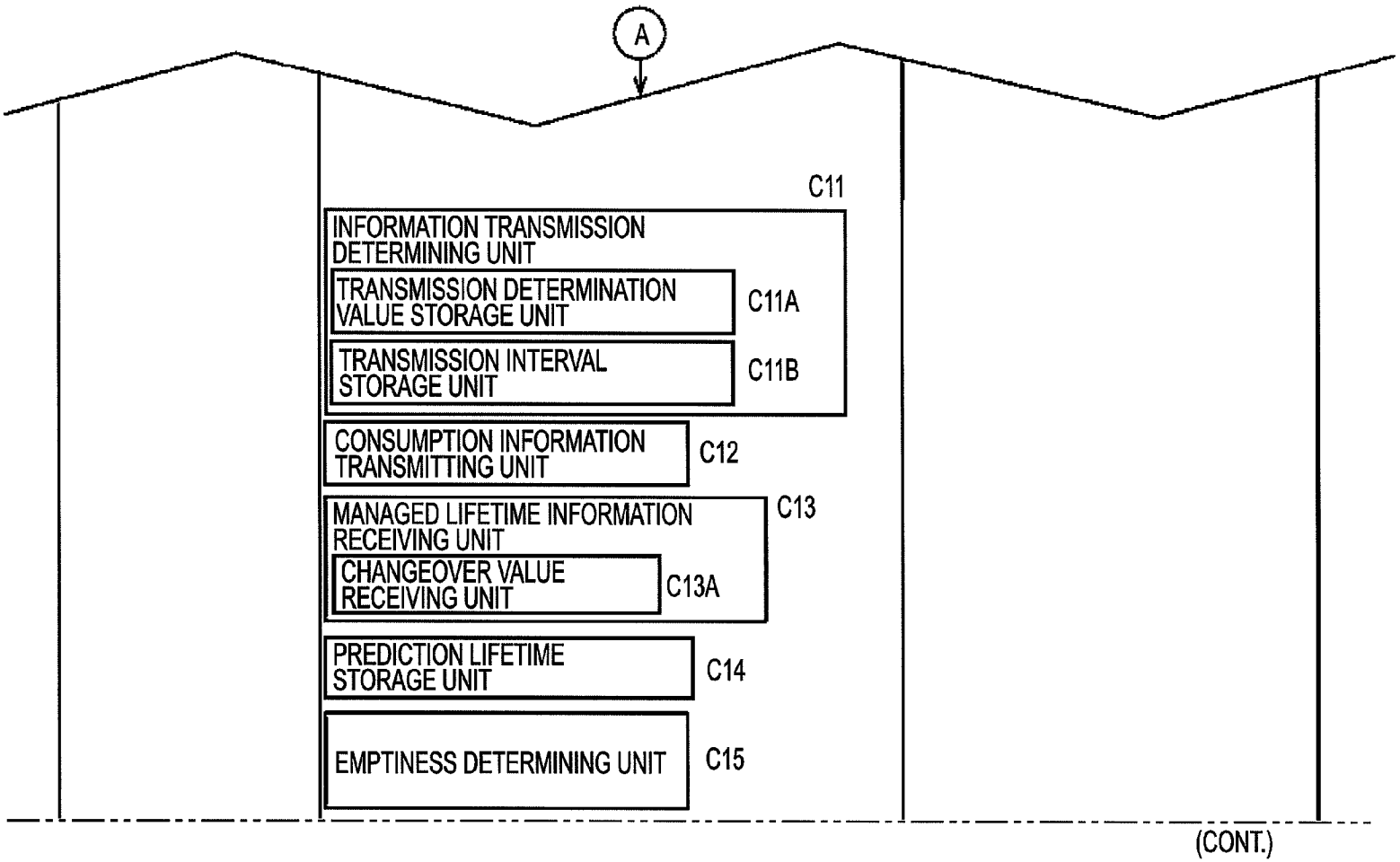
FIG. 14 a block diagram illustrating the functions of the controlling section of the image forming apparatus in accordance with Example 2 of the invention, and is a continuation from FIG. 13.

FIG. 14 a block diagram illustrating the functions of the controlling section of the image forming apparatus in accordance with Example 2 of the invention, and is a continuation from FIG. 13.

In FIGS. 13 and 14, the controller C of Example 2 is similar to that of Example 1 except that a connection determination unit C6' and a changeover value updating unit C17B' are provided in substitution of the connection determination unit C6 and the changeover value updating unit C17B of Example 1, and that a replacement counting unit C19 is added.

C19: Replacement Counting Unit

The replacement counting unit C19 counts a replacement frequency N1 of each of the toner cartridges Ky to Kk.

C6': Connection Determining Unit

The connection determining unit C6' in accordance with Example 2 has a frequency determining unit C6A and the main body prediction flag FL1, and determines whether or not the copier U is connected to the management server COM1 through the network N.

C6A: Frequency Determining Unit

The frequency determining unit C6A determines whether or not the replacement frequency N1 is equal to or less than a statistically determined frequency Na set in advance. It should be noted that, in Example 2, the statistically determined frequency Na is set to, for instance, Na=1.

C17B': Changeover Value Updating Unit

In the case where the copier U is connected to the management server COM1 and the aforementioned replacement frequency N1 is equal to or less than the statistically determined frequency Na, the changeover value updating unit C17B' in accordance with Example 2 updates the remaining 10% determination value tb on the basis of the information on the correction value tf received by the changeover value receiving unit C13A. Meanwhile, in the case where the copier U is connected to the management server COM1 and the replacement frequency N1 is greater than the statistically determined frequency Na or in the case where the copier U is not connected to the management server COM1, the changeover value updating unit C17B' updates the remaining 10% determination value tb on the basis of the remaining 10% determination value tb learned by the changeover value learning unit C16.

Therefore, in the case where the copier U is connected to the management server COM1 and the replacement frequency N1 is equal to or less than the statistically determined frequency Na, the prediction lifetime updating unit C17 updates the prediction lifetime of the toner cartridge Ky. Meanwhile, in the case where the copier U is connected to the management server COM1 and the replacement frequency N1 is greater than the statistically determined frequency Na or in the case where the copier U is not connected to the management server COM1, the prediction lifetime updating unit C17 updates the prediction lifetime of the toner cartridge Ky on the basis of the predicted remaining amount Z learned by the learning unit C16.

Description of the Flowchart of Example 2

Next, a description will be given of the flow of processing by the copier U in accordance with Example 2 with reference to a flowchart.

Description of the Flowchart of System Connection Determination Processing in Example 2

Figure 15:
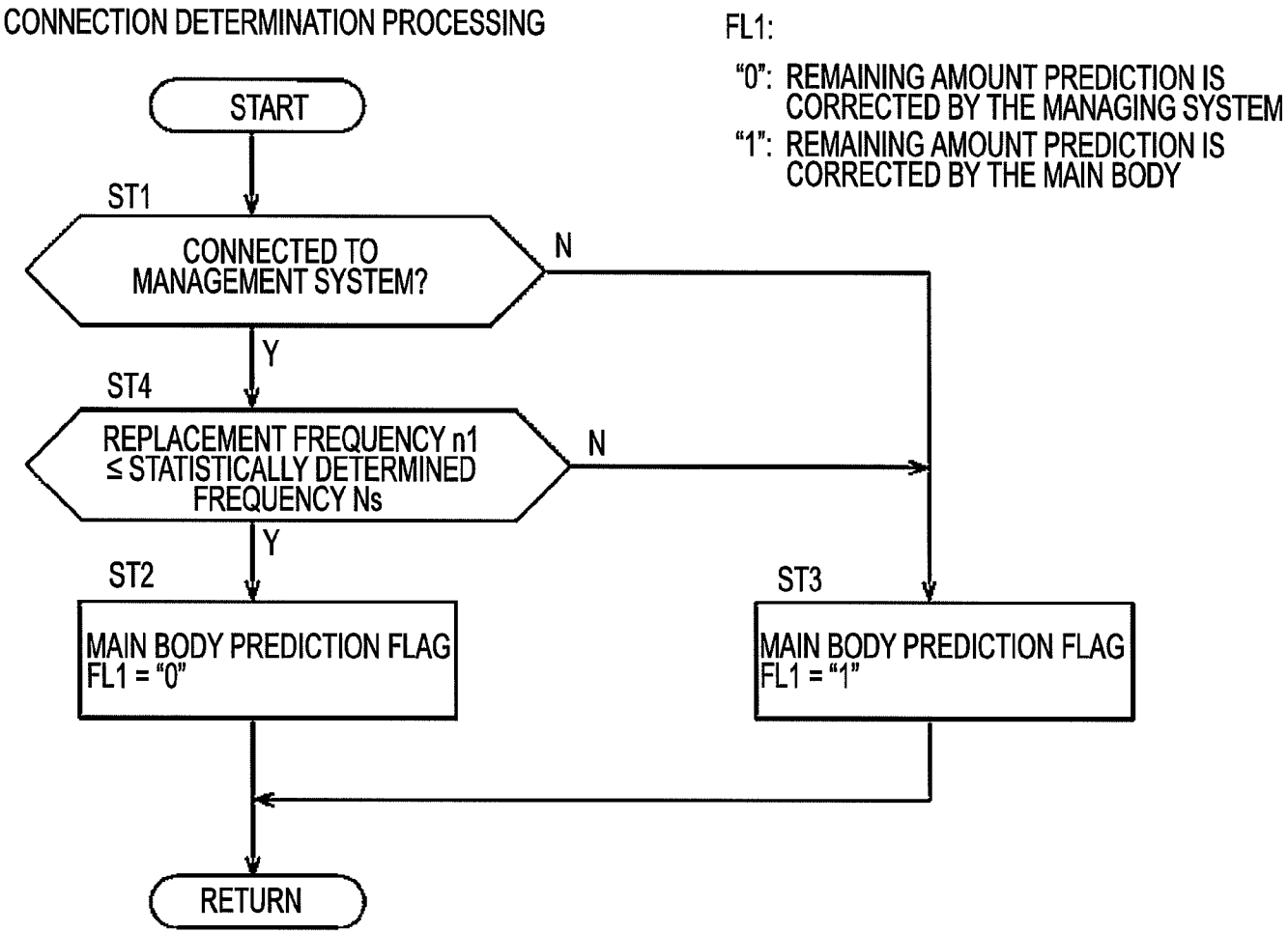
FIG. 15 is a flowchart of system connection determination processing in Example 2, and is a diagram corresponding to FIG. 7 of Example 1.

FIG. 15 is a flowchart of system connection determination processing in Example 2, and is a diagram corresponding to FIG. 7 of Example 1.

In FIG. 15, in the system connection determination processing in Example 2, the following processing ST4 is executed between ST1 and ST2 of Example 1.

In ST4 of FIG. 15, a determination is made as to whether or not the replacement frequency N1 is equal to or less than the statistically determined frequency Na. In the case of YES (Y), the operation proceeds to ST2, and in the case of NO (N), the operation proceeds to ST3.

Description of the Flowchart of Replacement Detection Processing in Example 2

Figure 16:
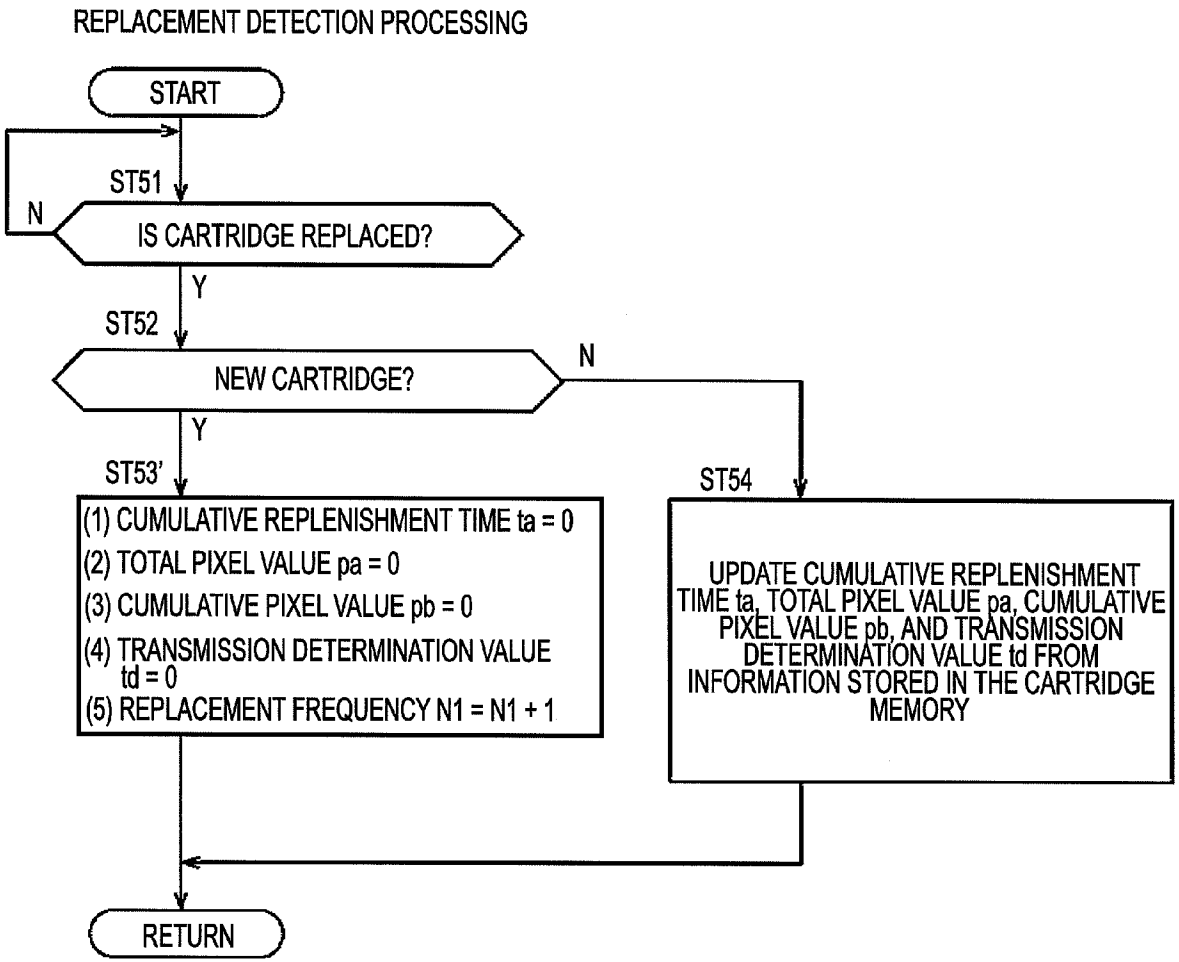
FIG. 16 is a flowchart of replacement detection processing in Example 2, and is a diagram corresponding to FIG. 10 of Example 1.

FIG. 16 is a flowchart of replacement detection processing in Example 2, and is a diagram corresponding to FIG. 10 of Example 1.

In FIG. 16, in the replacement detection processing in Example 2, the following processing ST53 is executed in substitution of ST53 of Example 1.

In ST53' in FIG. 16, the following processing (1) to (5) is executed, and the operation returns to ST51.

(1) The cumulative replenishment time ta is initialized to 0, i.e., ta=0.

(2) The total pixel value pa is initialized to 0, i.e., pa=0.

(3) The cumulative pixel value pb is initialized to 0, i.e., pb=0.

(4) The transmission determination value td is initialized to 0, i.e., td=0.

(5) A "1" is added to the replacement frequency N1, i.e., N1=N1+1.

Operation of Example 2

In the copier U in accordance with Example 2 having the above-described configuration, in the case where the copier U is connected to the management server COM1, if the replacement frequency N1 is equal to or less than the statistically determined frequency Na, the prediction of the statistic remaining amount Z and correction of the correction value tf are effected by the management server COM1. On the other hand, even if the copier U is connected to the management server COM1, if the replacement frequency N1 becomes greater than the statistically determined frequency Na, the prediction of the remaining amount Z and correction of the correction value tf in correspondence with an individual difference are effected by the copier U.

Accordingly, in the state in which the replacement frequencies N1 of the toner cartridges Ky to Kk are small, the prediction and learning of the remaining amount are carried out by using statistical data on the management server COM1 side where the amount of accumulated information is large and the accuracy is considered to be high. When the replacement frequency N1 is accumulated to a certain extent, the prediction of the remaining amount Z and the learning of the correction value tf are effected on the copier U side in correspondence with an individual difference. Hence, the accuracy of the prediction of the remaining amount Z is further improved.

(Modifications)

Although a detailed description has been given above of the examples of the invention, the invention is not limited to the foregoing examples, and various modifications are possible within the scope of invention, which is limited only by the appended claims. Modifications (H01) to (H013) of the invention will be illustrated below.

(H01) Although, in the foregoing examples, the copier U is illustrated by way of example of the image forming apparatus, the invention is not limited to the same, and is applicable to such as a printer, a facsimile machine, or a combination machine equipped with a plurality of such functions. In addition, the invention is not limited to an image forming apparatus of multi-color development, and may be configured by a monochromatic image forming apparatus.

(H02) Although, in the foregoing examples, it is preferable to perform the prediction of the remaining amount Z and the correction of the remaining 10% determination value tb and the emptiness determination time tc in correspondence with the connection to the network N, it is possible to effect only the prediction of the remaining amount Z or only the learning of the remaining 10% determination value tb and the emptiness determination time tc.

(H03) In the foregoing examples, as the correction value tf for computing the remaining 10% determination value tb and the emptiness determination time tc is transmitted from the management server COM1 to the image forming apparatuses U and V, information on the remaining 10% determination value tb and the emptiness determination time tc is indirectly transmitted to allow the image forming apparatuses U and V to compute the remaining 10% determination value tb and the emptiness determination time tc. However, the invention is not limited to this configuration, and the remaining 10% determination value tb and the emptiness determination time tc may be directly computed by the management server COM1 and may be transmitted to the image forming apparatuses U and V.

(H04) Although, in the foregoing examples, it is preferable to use the correction coefficient Ch, the correction coefficient Ch may be omitted. In addition, the correction coefficient Ch may be altered in correspondence with the replacement frequency of the toner cartridge. For example, if the correction coefficient Ch is made smaller with an increase in the replacement frequency of the toner cartridge, it is possible to make the learning effect through early cartridges large.

(H05) Specific numerical values and the like which have been illustrated in the foregoing examples may be altered, as required, in correspondence with the design, specifications, and the like.

[H06] In the foregoing examples, replenishment control is not limited to the method illustrated in the examples, and it is possible to adopt conventionally known arbitrary methods. Namely, replenishment control may be executed only by the pixel value, or replenishment control may be provided only by the toner density N1.

(H07) In the foregoing examples, as for the prediction of the remaining amounts Z of the toner cartridges Ky to Kk, the configuration has been illustrated in which the prediction is made on the basis of the cumulative replenishment time to of the dispenser device U3*b*. However, the invention is not limited to this configuration, and it is possible to use other arbitrary parameters, including parameters which are interlocked with the toner consumption amount and replenishment amount of each of the toner cartridges Ky to Kk, such as the number of prints, the number of revolution of each of the photoconductors Py to Pk, and the frequency of toner replenishment from the time of installation of each of the toner cartridges Ky to Kk. Similarly, the value which is interlocked with the toner consumption amount is not limited to the pixel value pb, and it is also possible to use as parameters such as the image area ratio and the lighting time of an LED of the latent image forming device ROS.

(H08) Although, in the foregoing examples, the remaining 10% determination value tb for effecting a changeover at the remaining 10% of the remaining amount Z has been illustrated as an example of the changeover value, the invention is not limited to the same, and the changeover value may be altered to an arbitrary numerical value such as a remaining 15%.

(H09) Although, in the foregoing examples, the determination of the emptiness of the toner cartridges Ky to Kk is made by using the emptiness detection sensor SN0, the invention is not limited to this configuration. The determination may be made on the basis of such as when an operator has detected a decline in the density by visually observing a printed image, or when the toner density sensors SN1 in the developing devices Gy to Gk have detected densities lower than preset densities.

(H010) Although, in the foregoing examples, the configuration has been illustrated in which the emptiness determination time tc is computed from the remaining 10% determination value tb, the invention is not limited to this method. For example, the cumulative replenishment time ta at the time when each of the toner cartridges Ky to Kk has become empty may be adopted as the next emptiness determination time tc of each of the toner cartridges Ky to Kk. Still alternatively, in a case where the toner cartridges Ky to Kk have been replaced numerous times, an average of the past cumulative replenishment time ta may be set as the emptiness determination time tc.

(H011) In the foregoing examples, the prediction of the remaining amount Z is made by using the cumulative replenishment time ta and the cumulative pixel value pb. However, in a case where the accuracy of one of the cumulative replenishment time ta and the cumulative pixel value pb is high due to such as a design or specifications, the prediction may be made by using only one of these parameters. For example, in the case where the prediction of the remaining amount is made by only the cumulative replenishment time ta, only the emptiness determination time tc may be set as a threshold for learning and correction.

It should be noted that a configuration is not unfeasible in which, contrary to the examples, the cumulative pixel value pb is used for the period when the remaining amount is large, whereas the cumulative replenishment time ta is used when the remaining amount becomes small.

(H012) Although, in the foregoing examples, the configuration has been illustrated in which the remaining 10% determination value tb and the emptiness determination time tc, which are thresholds for predicting the remaining amount Z of each of the toner cartridges Ky to Kk by using the cumulative replenishment time ta, are learned and corrected, the invention is not limited to the same. For example, it is also possible to adopt a configuration in which in a case where a parameter different from the cumulative replenishment time ta, e.g., a cumulative pixel value, is used, the prediction of the remaining amount is made by using only cumulative pixel values ((1−cumulative pixel value/cumulative pixel value for emptiness determination)×100), and the cumulative pixel value for emptiness determination, i.e., a threshold corresponding to the cumulative pixel value, is learned and corrected.

(H013) Although, in the foregoing examples, it is preferable to learn both the remaining 10% determination value tb and the emptiness determination time tc, it is also possible to adopt a configuration in which only one of them is learned.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a predicting unit that predicts a prediction lifetime of a consumable that is detachably mounted in the image forming apparatus, based on consumption information corresponding to an operation of the image forming apparatus;

a connection determining unit that determines whether or not the image forming apparatus is connected to a managing apparatus that manages a replacement time of the consumable that is detachably mounted in the image forming apparatus;

a consumption information transmitting unit that transmits the consumption information to the managing apparatus located outside the image forming apparatus;

a managed lifetime information receiving unit that receives managed lifetime information transmitted from the managing apparatus based on the consumption information;

a replacement time determining unit that determines whether or not the replacement time of the consumable has been reached;

a learning unit that effects a learning of the prediction lifetime based on the predicted prediction lifetime predicted by the predicting unit and the replacement time determined by the replacement time determining unit; and a prediction lifetime updating unit that, in a case where the image forming apparatus is connected to the managing apparatus, updates the prediction lifetime of the consumable based on the managed lifetime information, and that, in a case where the image forming apparatus is not connected to the managing apparatus, updates the prediction lifetime of the consumable based on the predicted prediction lifetime learned by the learning unit.

2. The image forming apparatus according to claim 1, wherein the learning unit effects the learning of the predicted prediction lifetime by learning a threshold value of the prediction lifetime corresponding to a case where the replacement time of the consumable is predicted to be reached, based on the predicted prediction lifetime predicted by the predicting unit and the replacement time determined by the replacement time determining unit.

3. The image forming apparatus according to claim 2, comprising:

the predicting unit comprising a first prediction lifetime predicting unit that predicts a first prediction lifetime based on first consumption information corresponding to the operation of the image forming apparatus and a second prediction lifetime predicting unit that predicts a second prediction lifetime based on second consumption information corresponding to the operation of the image forming apparatus and different from the first consumption information, the predicting unit being adapted to predict either one of the first prediction lifetime predicted by the first prediction lifetime predicting unit and the second prediction lifetime predicted by the second prediction lifetime predicting unit as the prediction lifetime of the consumable;

a changeover determining unit that determines which one of the first prediction lifetime and the second prediction lifetime is to be set as the prediction lifetime of the consumable, based on a changeover value for changing over the prediction of the prediction lifetime of the consumable from one of the first prediction lifetime and the second prediction lifetime to another one thereof;

the managed lifetime information receiving unit that receives the managed lifetime information comprising information on the changeover value transmitted from the managing apparatus based on the consumption information; and the learning unit that effects the learning of the predicted prediction lifetime by learning the changeover value based on the prediction lifetime predicted by the predicting unit and the replacement time determined by the replacement time determining unit.

4. The image forming apparatus according to claim 3, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

5. The image forming apparatus according to claim 2, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

6. The image forming apparatus according to claim 1, comprising:

the predicting unit comprising a first prediction lifetime predicting unit that predicts a first prediction lifetime based on first consumption information corresponding to the operation of the image forming apparatus and a second prediction lifetime predicting unit that predicts a second prediction lifetime based on second consumption information corresponding to the operation of the image forming apparatus and different from the first consumption information, the predicting unit being adapted to predict either one of the first prediction lifetime predicted by the first prediction lifetime predicting unit and the second prediction lifetime predicted by the second prediction lifetime predicting unit as the prediction lifetime of the consumable;

a changeover determining unit that determines which one of the first prediction lifetime and the second prediction lifetime is to be set as the prediction lifetime of the consumable, based on a changeover value for changing over the prediction of the prediction lifetime of the consumable from one of the first prediction lifetime and the second prediction lifetime to another one thereof;

the managed lifetime information receiving unit that receives the managed lifetime information comprising information on the changeover value transmitted from the managing apparatus based on the consumption information; and the learning unit that effects the learning of the predicted prediction lifetime by learning the changeover value based on the prediction lifetime predicted by the predicting unit and the replacement time determined by the replacement time determining unit.

7. The image forming apparatus according to claim 6, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

8. The image forming apparatus according to claim 1, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

9. A consumable management system comprising an image forming apparatus in which a consumable is detachably mounted and a managing apparatus that is located outside the image forming apparatus, is electrically connectable to the image forming apparatus, and manages a replacement time of consumables of the image forming apparatus, comprising:

the image forming apparatus comprising a predicting unit that predicts a prediction lifetime of a consumable that is detachably mounted in the image forming apparatus, based on consumption information corresponding to an operation of the image forming apparatus, a connection determining unit that determines whether or not the image forming apparatus is connected to the managing apparatus that manages the replacement time of the consumable that is detachably mounted in the image forming apparatus, a consumption information transmitting unit that transmits the consumption information to the managing apparatus located outside the image forming apparatus, a managed lifetime information receiving unit that receives managed lifetime information transmitted from the managing apparatus based on the consumption information, a replacement time determining unit that determines whether or not the replacement time of the consumable has been reached, a learning unit that effects a learning of the prediction lifetime based on the predicted prediction lifetime predicted by the predicting unit and the replacement time determined by the replacement time determining unit, and a prediction lifetime updating unit that, in a case where the image forming apparatus is connected to the managing apparatus, updates the prediction lifetime of the consumable based on the managed lifetime information, and that, in a case where the image forming apparatus is not connected to the managing apparatus, updates the prediction lifetime of the consumable based on the predicted prediction lifetime learned by the learning unit; and the managing apparatus comprising a consumption information receiving unit that receives the consumption information transmitted from the image forming apparatus, a managed lifetime deriving unit that derives the managed lifetime of the consumable of the image forming apparatus which transmitted the consumption information, based on the received consumption information and a predetermined managed lifetime information, and a managed lifetime information transmitting unit that transmits the managed lifetime information which is the managed lifetime derived by the managed lifetime deriving unit to the image forming apparatus which transmitted the consumption information.

10. The consumable management system according to claim 9, wherein the learning unit effects the learning of the predicted prediction lifetime by learning a threshold value of the prediction lifetime corresponding to a case where the replacement time of the consumable is predicted to be reached, based on the predicted prediction lifetime predicted by the predicting unit and the replacement time determined by the replacement time determining unit.

11. The consumable management system according to claim 10, comprising:

the predicting unit comprising a first prediction lifetime predicting unit that predicts a first prediction lifetime based on first consumption information corresponding to the operation of the image forming apparatus and a second prediction lifetime predicting unit that predicts a second prediction lifetime based on second consumption information corresponding to the operation of the image forming apparatus and different from the first consumption information, the predicting unit being adapted to predict either one of the first prediction lifetime predicted by the first prediction lifetime predicting unit and the second prediction lifetime predicted by the second prediction lifetime predicting unit as the prediction lifetime of the consumable;

a changeover determining unit that determines which one of the first prediction lifetime and the second prediction lifetime is to be set as the prediction lifetime of the consumable, based on a changeover value for changing over the prediction of the prediction lifetime of the consumable from one of the first prediction lifetime and the second prediction lifetime to another one thereof;

the managed lifetime information receiving unit that receives the managed lifetime information comprising information on the changeover value transmitted from the managing apparatus based on the consumption information; and the learning unit that effects the learning of the predicted prediction lifetime by learning the changeover value based on the prediction lifetime predicted by the predicting unit and the replacement time determined by the replacement time determining unit.

12. The consumable management system according to claim 11, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

13. The consumable management system according to claim 9, comprising:

the predicting unit comprising a first prediction lifetime predicting unit that predicts a first prediction lifetime based on first consumption information corresponding to the operation of the image forming apparatus and a second prediction lifetime predicting unit that predicts a second prediction lifetime based on second consumption information corresponding to the operation of the image forming apparatus and different from the first consumption information, the predicting unit being adapted to predict either one of the first prediction lifetime predicted by the first prediction lifetime predicting unit and the second prediction lifetime predicted by the second prediction lifetime predicting unit as the prediction lifetime of the consumable;

a changeover determining unit that determines which one of the first prediction lifetime and the second prediction lifetime is to be set as the prediction lifetime of the consumable, based on a changeover value for changing over the prediction of the prediction lifetime of the consumable from one of the first prediction lifetime and the second prediction lifetime to another one thereof;

the managed lifetime information receiving unit that receives the managed lifetime information comprising information on the changeover value transmitted from the managing apparatus based on the consumption information; and the learning unit that effects the learning of the predicted prediction lifetime by learning the changeover value based on the prediction lifetime predicted by the predicting unit and the replacement time determined by the replacement time determining unit.

14. The consumable management system according to claim 13, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

15. The consumable management system according to claim 9, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

16. The consumable management system according to claim 10, comprising:

a replacement counting unit that counts a replacement frequency of the consumable;

a frequency determining unit that determines whether or not the replacement frequency is equal to or less than a statistically determined frequency set in advance; and the prediction lifetime updating unit that, in the case where the image forming apparatus is connected to the managing apparatus and the replacement frequency is equal to or less than the statistically determined frequency, updates the prediction lifetime of the consumable based on the managed lifetime information, and that, in a case where the image forming apparatus is connected to the managing apparatus and the replacement frequency is greater than the statistically determined frequency or in a case where the image forming apparatus is not connected to the managing apparatus, updates the prediction lifetime of the consumable based on the predicted prediction lifetime learned by the learning unit.

* * * * *